US006004736A

United States Patent [19]

Taguchi et al.

[11] Patent Number: 6,004,736

[45] Date of Patent: Dec. 21, 1999

[54] SILVER HALIDE PHOTOGRAPHIC LIGHT-SENSITIVE MATERIAL

[75] Inventors: Toshiki Taguchi; Kozo Sato, both of Kanagawa, Japan

[73] Assignee: Fuji Photo Film Co., Ltd., Kanagawa, Japan

[21] Appl. No.: 08/993,177

[22] Filed: Dec. 18, 1997

[30] Foreign Application Priority Data

Dec. 26, 1996 [JP] Japan ..... 8-357191

[51] Int. Cl.[6] ..... G03C 1/08; G03C 7/26; G03C 7/32

[52] U.S. Cl. ..... 430/543; 430/448; 430/486; 430/502; 430/464

[58] Field of Search ..... 430/543, 448, 430/486, 502, 464

[56] References Cited

U.S. PATENT DOCUMENTS

| | | | |
|---|---|---|---|
| 3,801,321 | 4/1974 | Evans et al. | 430/537 |
| 5,792,599 | 8/1998 | Taguchi | 430/505 |

OTHER PUBLICATIONS

Patent Abstracts of Japan, vol. 007, No. 070 (P–185), Mar. 23, 1983 for JP 58 001139 A (Konishiroku Shashin Kogyo KK), Jan. 6, 1983.

Patent Abstracts of Japan, vol. 012, No. 058 (P–669), Feb. 20, 1988 for JP 62 203158 A (Fuji Photo Film Co, Ltd), Sep. 7, 1987.

Patent Abstracts of Japan, vol. 008, No. 242 (P–311), Nov. 7, 1984 for JP 59 116740 A (Konishiroku Shashin Kogyo KK), Jul. 5, 1984.

Patent Abstracts of Japan, vol. 010, No. 060 (P–435), 11 Mar. 1986 for JP 60 203942 A (Konishiroku Shashin Kogyo KK), Oct. 15, 1985.

*Primary Examiner*—Geraldine Letscher

*Attorney, Agent, or Firm*—Sughrue, Mion, Zinn, Macpeak & Seas, PLLC

[57] ABSTRACT

The object is to provide a silver halide photographic light-sensitive material containing a developing agent which can effect color developing reaction efficiently with a known coupler without being restricted by the kind of the coupler. Namely, the present invention is a silver halide photographic light-sensitive material comprising a support having thereon at least one layer comprising at least one compound represented by the following general formula (1):

wherein, $R_1$ to $R_4$ represent a hydrogen atom or substituent, A represents a hydroxyl group or substituted amino group, X represents a di- or higher valent connecting group selected from —CO—, —SO—, —$SO_2$— and —PO<, Y represents a bivalent connecting group, Z represents a group which is nucleophilic and can attack X when the present compound is oxidized, and $R_1$ and $R_2$, and $R_3$ and $R_4$ may be linked each other to form a ring, respectively.

7 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material, and more particularly, to a silver halide photographic light-sensitive material containing a developing agent.

2. Description of the Related Art

A photographic method using silver halide has conventionally been most widely used since it has more excellent photographic characteristics such as sensitivity, gradation control and the like as compared with other photographic methods, for example, an electrophotographic method and diazo photographic method. Further, the photographic method using silver halide has been intensively studied nowadays since it can provide the maximum image quality as a color hard copy.

Recently, a method for image forming treatment of a light-sensitive material using silver halide including conventional wet treatment has been improved, and consequently, an instant photographic system containing a developing solution therein and further a system which can obtain an image simply and rapidly using dry heat developing treatment and the like by heating and the like have been developed. In particular, a heat developing light-sensitive material is described in "Base for Photographic Technology (ed. by Non-Silver Salt Photography, Corona Corp.)", p. 242, and the contents thereof only refer to a black-and-white image forming method typically represented by dry silver. Recently, as a heat developing color light-sensitive material, products such as Pictography and Pictostat are commercially available from Fuji Photo Film Co., Ltd. In the above-described simple and rapid treatment method, there is effected color image formation using a redox-type coloring material to which a preformed dye has been bonded.

As a method for color image formation of a photographic light-sensitive material, a method utilizing a coupling reaction of a coupler with a developing agent oxidation product is most general, and with respect to an idea of a heat developing color light-sensitive material according to this method, there are a lot of applications such as U.S. Pat. Nos. 3,761,270, 4,021,240, Japanese Patent Application Laid-Open (JP-A) Nos. 59-231539, 60-128438 and the like.

When a silver halide photographic light-sensitive material capable of being treated simply and rapidly as described above is designed, a treating solution including a developing solution is not used. Therefore, it is essential that the light-sensitive material contains a developing agent. Usually, the developing agent is a reducing agent. Therefore, a general developing agent is a compound which is easily oxidized by an oxygen molecule in air. Such a compound can not effectively be used for the above-described treatment. To solve this problem, there have been proposed many ideas such as methods for solid dispersion addition of p-sulfoneamidephenol described in U.S. Pat. No. 4,021,240, p-aminophenylsulfamic acid described in JP-A No. 60-128439, sulfonylhydrazine described in JP-A No. 8-227131, sulfonylhydrazone described in JP-A No. 8-202002, carbamoylhydrazine described in EP No. 0727708A1, carbamoylhydrazine described in JP-A No. 8-234390, and 1-phenyl-3-pyrazolidinone derivative described in JP-A No. 2-230143, as a developing agent which can be contained in the light-sensitive material, in the present field.

The inventors of the present invention have studied the silver halide photographic light-sensitive material containing a developing agent. As a result, they have found that when a p-aminophenol derivative and p-phenylenediamine derivative are used as a developing agent, a dye which can manifest excellent hue can be formed, with combination of a coupler used in the art. Particularly, they have found that sulfoneamidephenol described in U.S. Pat. No. 4,021,240, JP-A No. 60-128438 and the like is a compound excellent in discrimination and storage when it is used in a light-sensitive material.

However, they also have found that p-sulfoneamidephenol manifests extremely low color developing efficiency when it is combined with a so-called 2-equivalent coupler which is usually used in the art. The reason is that the coupling site of this compound is substituted with a sulfonyl group, and this sulfonyl group releases in the form of a sulfinic acid at the time of coupling reaction, therefore, a releasing group on the coupler side has to release in the form of a cation. Therefore, this compound reacts with a 4-equivalent coupler which can release a proton as a releasing group and develops color at the time of the coupling reaction. However, in the case of a 2-equivalent coupler, of which the releasing group is an anion, it is very difficult to effect color development, though reaction itself does occur.

Because reaction with a 2-equivalent coupler is difficult, when a developing agent like p-sulfoneamidephenol is used, it is difficult to construct a system in which a diffusive dye is formed by releasing a functional compound from the coupling site of a coupler, by substituting a ballasting group onto the coupling site and releasing the ballasting group, and the like. Further, the 4-equivalent coupler is known to have a problem also in formalin gas resistance. Therefore, the present inventors have investigated means by which a developing agent using aminophenol type and phenylenediamine type developing agents having a releasing group at the coupling site as described above can cause a color developing reaction efficiently with a 2-equivalent coupler.

SUMMARY OF THE INVENTION

The object of the present invention is to provide a silver halide photographic light-sensitive material containing a developing agent which can cause a color developing reaction efficiently with a known coupler, especially a 2-equivalent coupler which is appropriately selected without being restricted by the kind of coupler to be used and can solve various above-described conventional problems.

The above-described objective can be solved by the following 1) to 4).

1) A silver halide photographic light-sensitive material comprising a support having thereon at least one layer comprising at least one compound represented by the following general formula (1):

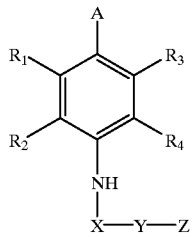

wherein, $R_1$ to $R_4$ represent a hydrogen atom or substituent, A represents a hydroxyl group or a substituted amino group, X represents a first connecting group with a valency of two or more selected from the group consisting of —CO—, —SO—, —$SO_2$— and —PO<, Y represents a second, bivalent connecting group, Z represents a group which is nucleophilic and can attack X when the compound is oxidized, and $R_1$ and $R_2$ may be linked each other to form a ring and $R_3$ and $R_4$ may be linked each other to form a ring.

2) The silver halide photographic light-sensitive material according to the above-described 1), wherein A represents a hydroxyl group.

3) The silver halide photographic light-sensitive material according to the above-described 1) or 2), wherein Y is selected from the group consisting of a 1,2-cycloalkylene group, 1,2-arylene group and a 1,8-naphthylene group.

4) The silver halide photographic light-sensitive material according to any of the above-described 1) to 3), wherein the material further contains a 2-equivalent coupler.

DESCRIPTION OF THE PREFERRED EMBODIMENT

The silver halide photographic light-sensitive material of the present invention is described in detail below.

The silver halide photographic light-sensitive material of the present invention comprises a support containing at least one compound represented by the general formula (1).

The compound represented by the general formula (1) is described in detail below.

The compound represented by the general formula (1) is a developing agent classified to an aminophenol derivative and phenylenediamine derivative. Hereinafter, the above-described "compound represented by the general formula (1)" may be referred to as "developing agent represented by the general formula (1)".

In the general formula (1), $R_1$ to $R_4$ independently represents a hydrogen atom or a substituent, and examples thereof may include a halogen atom (such as chloro and bromo groups), an alkyl group (such as methyl, ethyl, isopropyl, n-butyl and t-butyl groups), an aryl group (such as phenyl, tolyl group and xylyl groups), a carbonamide group (such as acetylamino, propionylamino, butyloylamino and benzoylamino groups), a sulfonamide group (such as methanesulfonylamino, ethanesulfonylamino, benzenesulfonylamino and toluenesulfonylamino groups), an alkoxy group (such as methoxy and ethoxy groups), an aryloxy group (such as a phenoxy group), an alkylthio group (such as methylthio, ethylthio and butylthio groups), an arylthio group (such as phenylthio and tolylthio groups), a carbamoyl group (such as methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl, ethylphenylcarbamoyl and benzylphenylcarbamoyl groups), a sulfamoyl group (such as methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl and benzylphenylsulfamoyl groups), a cyano group, a sulfonyl group (such as methanesulfonyl, ethanesulfonyl, phenylsulfonyl, 4-chlorophneylsulfonyl and p-toluenesulfonyl groups), an alkoxycarbonyl group (such as methoxycarbonyl, ethoxycarbonyl and butoxylcarbonyl groups), an aryloxycarbonyl group (such as a phenoxycarbonyl group), an acyl group (such as acetyl, propionyl, butyloyl, benzoyl and alkylbenzoyl groups), a ureido group (such as methylaminocarbonamide and diethylaminocarbonamide groups), a urethane group (such as methoxycarbonamide and butoxycarbonamide groups), an acyloxy group (such as acetyloxy, propionyloxy and butyloyloxy groups) and the like.

Among $R_1$ to $R_4$, $R_2$ and/or $R_4$ preferably represents a hydrogen atom. When A represents a hydroxy group, the total of Hammett's constants $\sigma_p$ of $R_1$ to $R_4$ is preferably 0 or more, and when A represents a substituted amino group, the total of Hammett's constants $\sigma_p$ of $R_1$ to $R_4$ is preferably 0 or less.

A represents a hydroxy group or substituted amino group (such as dimethylamino, diethylamino and ethylhydroxyethylamino groups), and preferably a hydroxy group.

X represents a first connecting group with selected from —CO—, —SO—, —$SO_2$— and —PO<.

Z represents a nucleophilic group, and represents a group having a function to form a dye by nucleophilic attack to a carbon, sulfur or phosphorus atom represented by X after the coupling reaction of a coupler with an oxidation product produced when a compound represented by the general formula (1) reduces silver halide.

In the nucleophilic group, an atom having an unshared electron pair (such as nitrogen, phosphorus, oxygen, sulfur and selenium atoms, and the like) and an anionic species (such as nitrogen, oxygen, carbon and sulfur anions) manifest nucleophilicity as is usual in the field of organic chemistry. Examples of the nucleophilic group may include groups carrying partial structures or dissociated moieties thereof. Examples of a partial structure having nucleophilicity included in Z.

(underlined atoms have nucleophilicity)

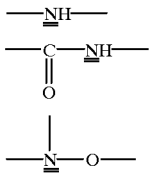

Regarding these groups, anions thereof have nucleophilicity.

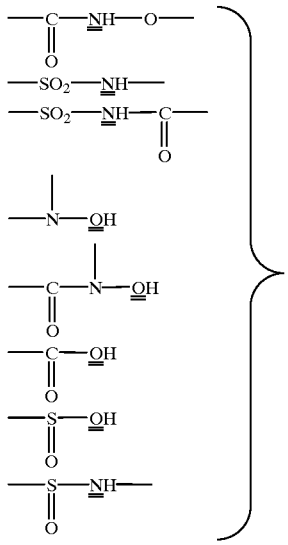

Y represents a second, bivalent connecting group. The connecting group represents a group which connects Z to such a position that convenient intramolecular nucleophilic attack to X via Y is possible. In practice, it is preferable that atoms are connected so that a 5 to 6-membered ring can be formed containing 5 to 6 atoms in transition condition when the nucleophilic group effects nucleophilic attack to X.

Preferable examples of Y may include 1,2- or 1,3-alkylene group, 1,2-cycloalkylene group, Z-vinylene group, 1,2-arylene group, 1,8-naphthalene group and the like.

$R_1$ and $R_2$ may be linked each other to form a ring. $R_3$ and $R_4$ may be linked each other to form a ring.

In a process for adding a developing agent represented by the above-described general formula (1) to a silver halide photographic light-sensitive material, a coupler, developing agent and an organic solvent having high boiling point (such as alkyl phosphate, alkyl phthalate and the like) can be first mixed and dissolved in an organic solvent having low boiling point (such as ethyl acetate, methyl ethyl ketone and the like), and dispersed in water using an emulsifying dispersion method known in the art before addition. Further, the addition is also possible through a solid dispersion method described in JP-A No. 63-271339.

The compound represented by the general formula (1) is preferably an oil-soluble compound when the addition is effected by the emulsifying dispersion method among the above-described addition methods. For this purpose, it is preferable that at least one group having ballasting properties is contained. This ballasting group represents an oil-solubilized group, and is a group containing an oil-soluble partial structure having usually 8 to 80, preferably 10 to 40 carbon atoms. Therefore, it is preferable that substitution by a ballasting group having 8 or more carbon atoms exists in any of $R_1$ to $R_4$, X, Y and Z. Particularly, when the compound represented by the general formula (1) is used in a color light-sensitive material of the diffusion transfer type, it is preferable that substitution by a ballasting group exists in any of Y and Z. The number of carbon atoms of the ballasting group is preferably from 8 to 80, and more preferably from 8 to 20.

The amount added of the developing agent represented by the general formula (1) is in a wide range, and preferably from 0.001 to 1000 mmol/$m^2$, and more preferably from 0.01 to 50 mmol/$m^2$.

The developing agent represented by the general formula (1) can be synthesized by appropriately combining known organic synthesis reactions step by step, and specific examples for synthesizing the developing agent represented by the general formula (1) are described below. In this specification, the developing agent represented by the general formula (1) is sometimes represented by "Developing agent D-No", and this "No" means a number for distinguishing the developing agent.

<Synthesis of developing agent D-1>

A developing agent D-1 was synthesized by a synthesis route as shown below (Scheme-1).

Scheme-1

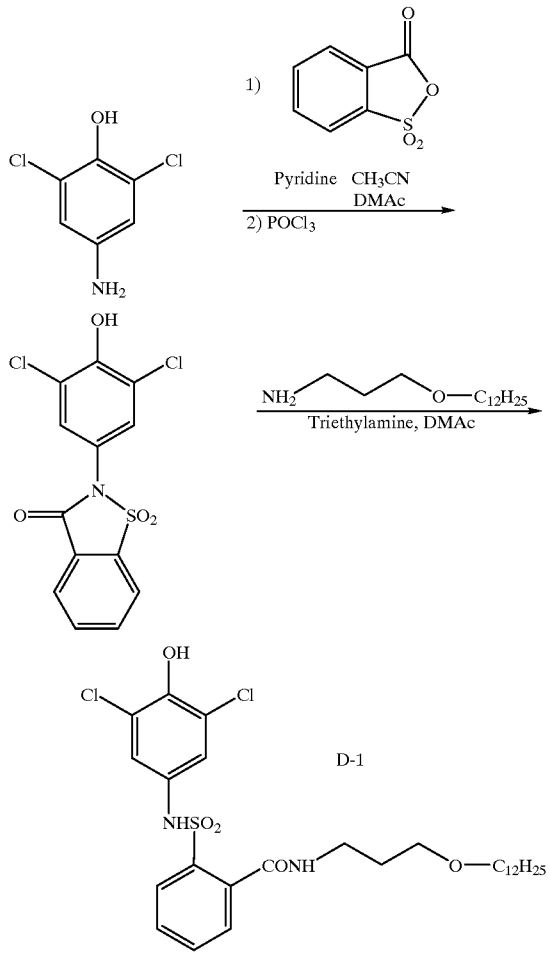

(1) Synthesis of compound A

Into a 2L three-necked flask equipped with a condenser and thermometer were charged 600 ml of acetonitrile and 178 g (1 mol) of 2,6-dichloro-4-aminophenol, and the mixture was kept at 0° C. or lower with stirring on a methanol-ice bath. When 81 ml (1 mol) of pyridine was added to this mixture with passing nitrogen flow, exothermic reaction was occurred to obtain a uniform solution. The temperature was lowered to 5° C., and to this solution was added a solution obtained by dissolving 184 g (1 mol) of o-sulfobenzoic anhydride in 250 ml of N,N-dimethylacetoamide (DMAc) carefully so that the temperature in the flask did not exceed 35° C. After completion of the addition, the mixture was further stirred for 1 hour at room temperature to conduct the reaction, then, to this was added dropwise 200 g (1.3 mol) of phosphorus oxychroride. Exothermic reaction was occurred upon addition, and the temperature increased to about 60° C. or lower. The temperature was kept at 60 to 70° C. with a hot water bath, and the reaction was continued for another 5 hours with stirring. After completion of the reaction, this reaction mixture was added to 10L of ice water, and the deposited crystals separated by filtration. The resultant crude crystals were re-crystallized from a mixed solvent of acetnitrile-DMAc to obtain 300 g of crystals of compound A (yield: 87%).

(2) Synthesis of developing agent D-1 from compound A

Into a 1L three-necked flask equipped with a condenser and thermometer were charged 172 g, (0.5 mol) of compound A, 600 ml of DMAC, 140 ml (1 mol) of triethylamine and 122 g (0.5 mol) of lauryloxypropylamine, and they were reacted for 3 hours at a temperature of 70° C. with stirring. After completion of the reaction, this reaction mixture was added to 10L of ice-hydrochloric acid solution, and the deposited crystals separated by filtration. The resultant crude crystals were re-crystallized from ethanol to obtain 265 g of crystals of a developing agent D-1 (yield: 90%).

<Synthesis of developing agent D-7>

A developing agent D-7 was synthesized by a synthesis route as shown below (Scheme-2).

Scheme-2

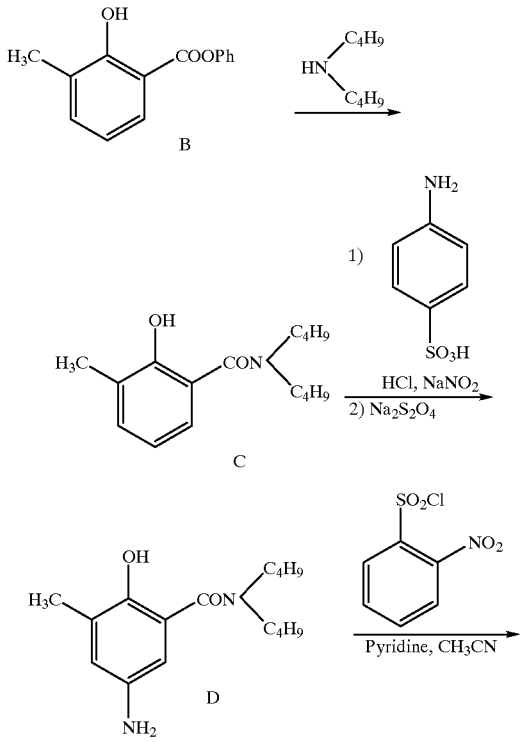

-continued

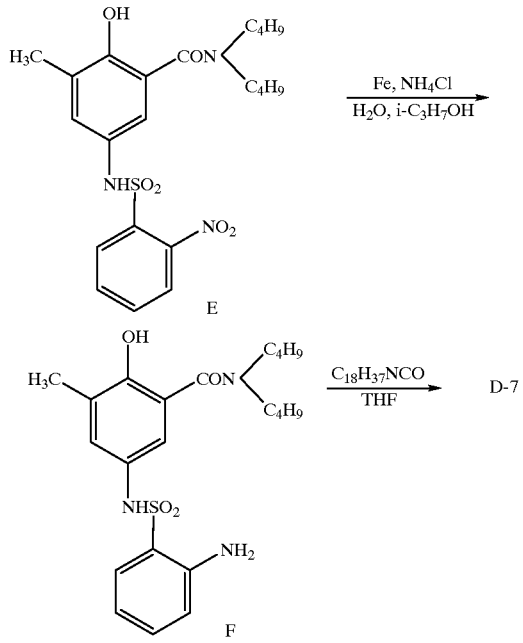

(1:) Synthesis of compound C from compound B

Into a 1L eggplant type flask were charged a rotator for a magnetic stirrer, 228 g (1 mol) of compound B and 155 g (1.2 mol) of di-n-butylamine, a gas introducing tube was installed to this flask, and the tube was connected to an aspirator through a pressure resistant rubber tube. The solution was stirred using a magnetic stirrer while reduced pressure was maintained by water flow, and the temperature thereof was raised up to 120° C. to cause deposition of crystals of phenol in the glass section of the aspirator. The reaction was continued for 4 hours, and when the deposition of phenol crystals stopped, the temperature was lowered again to room temperature. This reaction mixture was added to 3L of a hydrochloric acid solution, and the deposited crystals were separated by filtration. This crude crystal was re-crystallized from 1L of methanol to obtain 242 g of crystals of compound C (yield 92%).

(2) Synthesis of compound D from compound C

Into a 5L beaker was charged 66 g (0.25 mol) of compound C, then 100 ml of methanol, 250 g (1.8 mol) of potassium carbonate and 500 ml of water were added and they were dissolved completely. This solution was kept at 0° C. or lower with stirring. A separately prepared solution like that was dissolved completely in a solution prepared by dissolving 65 g (0.375 mol) of sulfanilic acid and 16.5 g of sodium hydroxide into 30 ml of water. To this was added 90 ml of concentrated hydrochloric acid to prepare a slurry solution. The prepared solution was vigorously stirred while being maintained at 0° C. or lower, and to this was gradually added a solution prepared by dissolving 27.5 g (0.4 mol) of sodium nitrite into 50 ml of water, to produce a diazonium salt. This reaction was effected with the ice added appropriately so that the temperature was kept at 0° C. or lower. Thus diazonium salt obtained was gradually added to the solution of the compound C which had been stirred. This reaction was also effected while adding ice appropriately so that the temperature was kept at 0° C. or lower. As the addition proceeded, the solution turned red due to the azo dye. After completion of the addition, the solution was further reacted for 30 minutes at 0° C. or lower, and when disappearance of the raw materials was recognized, 500 g (3 mol) of sodium hydrosulfite in the form of a powder was added. When this solution was heated to 50° C., reduction of the azo group occurred with intense foaming. When the foaming stopped and the solution was decolorized to a yellowish clear solution, it was cooled to 10° C. to find deposition of crystals. The deposited crystals were separated by filtration, and the resultant crude crystals were re-crystallized from 300 ml of methanol to obtain 56 g of crystals of a compound D (yield: 80%).

(3) Synthesis of compound E from compound D

Into a 1L three-necked flask equipped with a condenser were charged 200 ml of acetonitrile, 56 g (0.2 mol) of compound D and 16 ml (0.2 mol) of pyridine, and to this was added 44 g (0.2 mol) of o-nitrobenzenesulfonyl chloride over a period of 30 minutes. After completion of the addition, the mixture was further stirred at room temperature for 2 hours to complete the reaction. This reaction mixture was added to 3L of a hydrochloric acid solution, and the deposited crystals were separated by filtration. The crude crystals were recrystallized from methanol to obtain 86 g of crystals of a compound E (yield: 93%).

(4) Synthesis of compound F from compound E

Into a 3L three-necked flask equipped with a condenser were charged 1L of isopropanol, 100 ml of water, 10 g of ammonium chloride and 100 g of a reduced iron powder, and the mixture was heated while stirring on a water vapor bath until isopropanol was mildly reduced. Under reflux conditions, stirring was continued for about 15 minutes. To this was gradually added 100 g of compound E over a period of 30 minutes. Intense reduction occurred on each addition, and the reduction reaction progressed. After completion of the addition, the solution was further reacted for 1 hour under reflux. This reaction mixture was filtered through a Buchner funnel on which celite was spread with heating, the residue was further washed with methanol. This was also filtered and added to the filtrate. When the filtrate was condensed under reduced pressure to about 300 cc, crystals were deposited, then, this filtrate was cooled to grow the crystals. The crystals were filtered, and washed with methanol before drying to obtain 80 g of crystals of a compound F (yield: 85%).

(5) Synthesis of developing agent D-7 from compound F

Into a 1L three-necked flask equipped with a condenser and a thermometer were charged 300 ml of tetrahydrofuran and 87 g (0.2 mol) of compound F. The mixture was stirred at room temperature. To this was added dropwise 59.1 g (0.2 mol) of octadecyl isocyanate. In this procedure, the temperature was maintained at 30° C. or less. After the addition, the mixture was stirred for 2 hours, then, the reaction mixture was added to 5L of ice water. When crystals were deposited, they were separated by filtration, and re-crystallized from 600 ml of isopropanol to obtain 139 g of crystals of a developing agent D-7 (yield: 95%).

Specific examples of the compounds represented by general formula (1) may include, but are not limited to, the following developer agents D-1 to D-38.

D-1

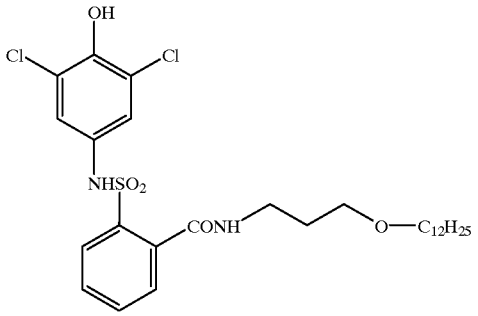

D-2

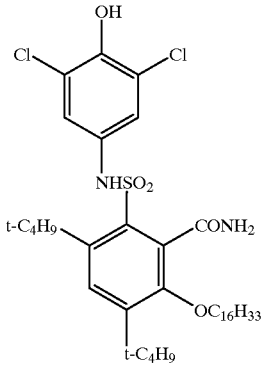

-continued
D-3
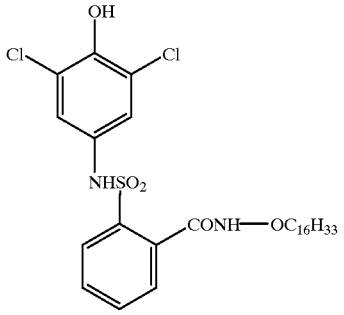
D-4
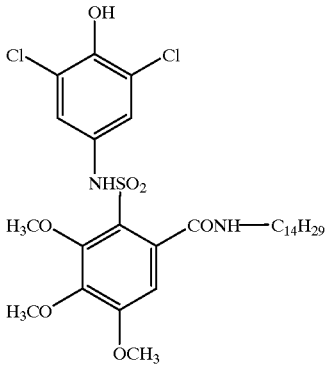
D-5
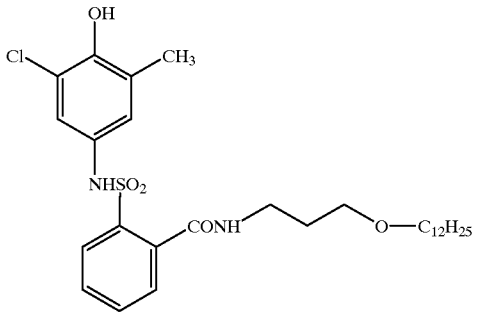
D-6
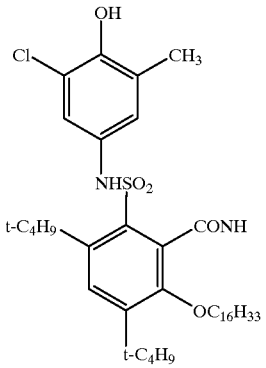

-continued
D-7
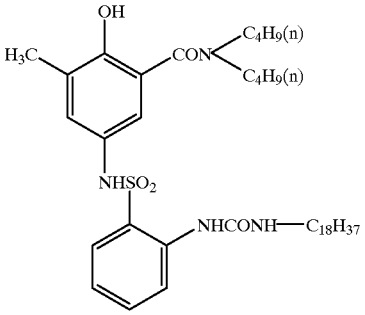
D-8
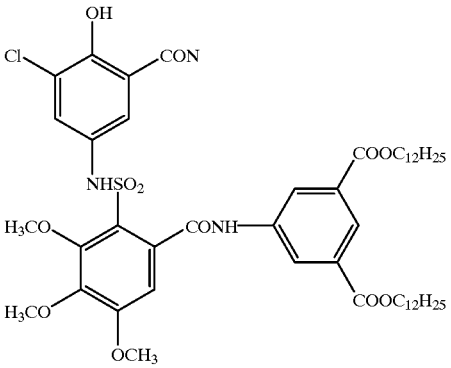
D-9
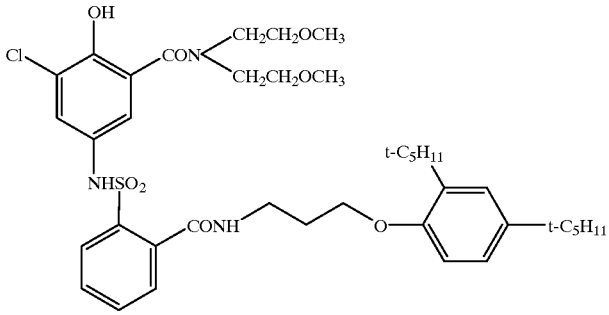
D-10
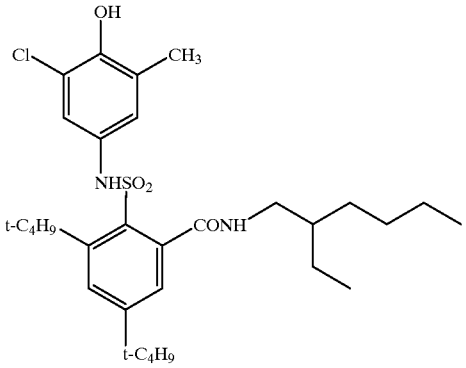

-continued
D-11
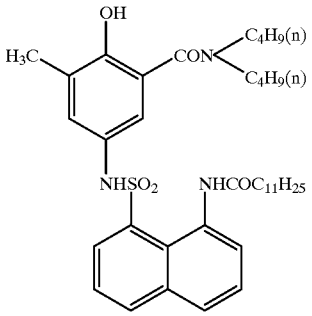
D-12
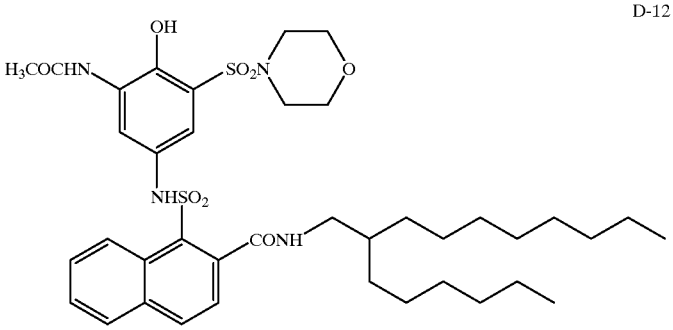
D-13
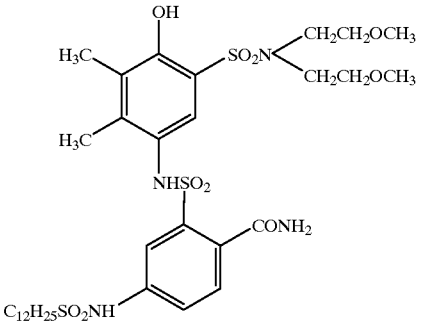
D-14
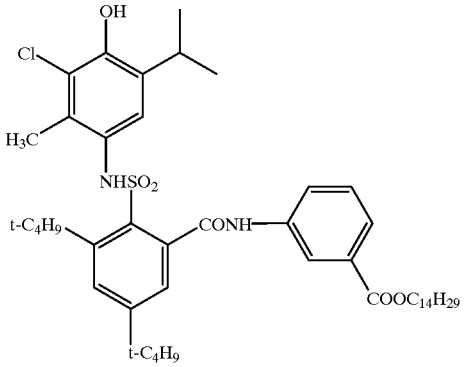

-continued
D-15
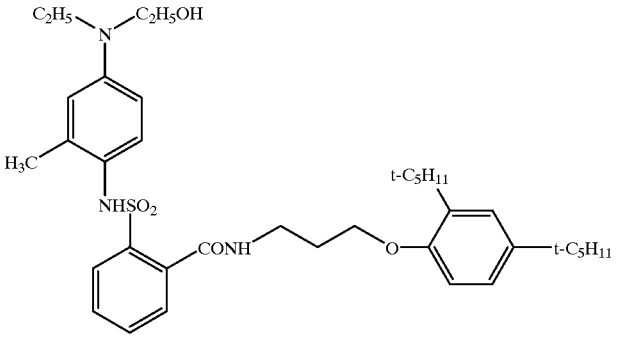
D-16
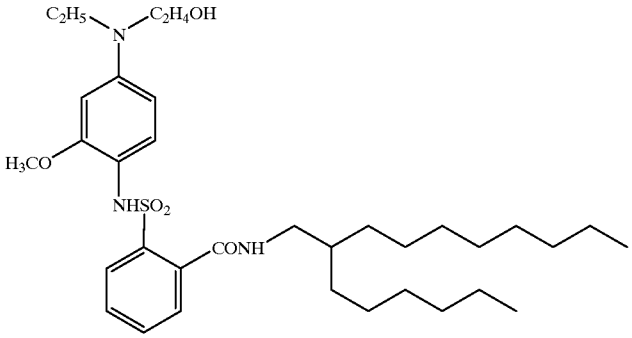
D-17
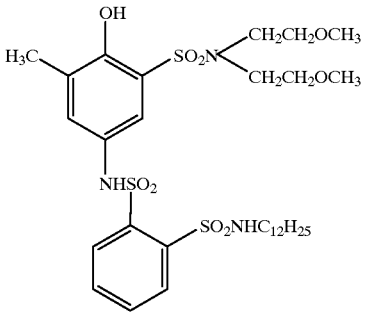
D-18
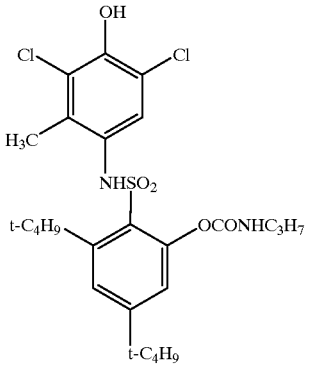

-continued
D-19
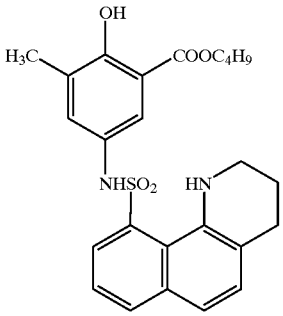
D-20
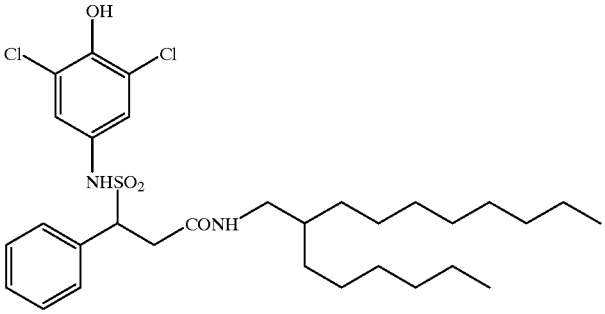
D-21
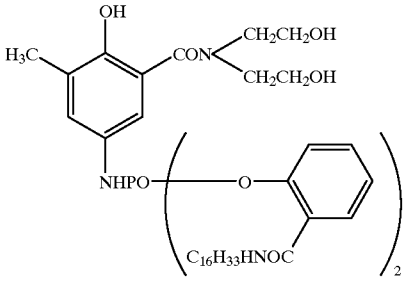
D-22
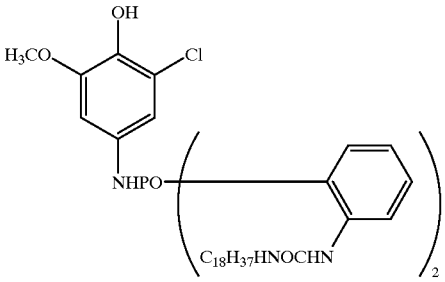
D-23
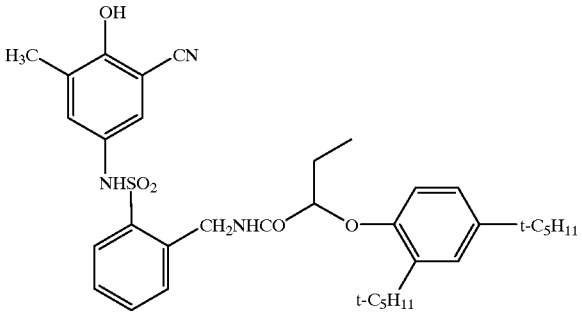

-continued
D-24
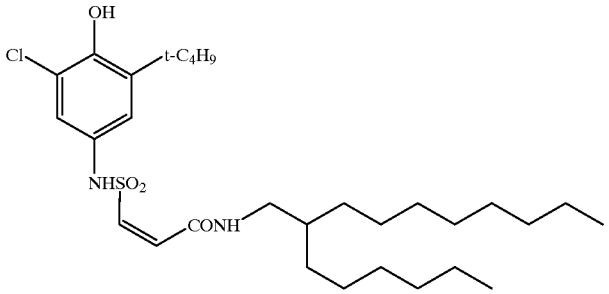
D-25
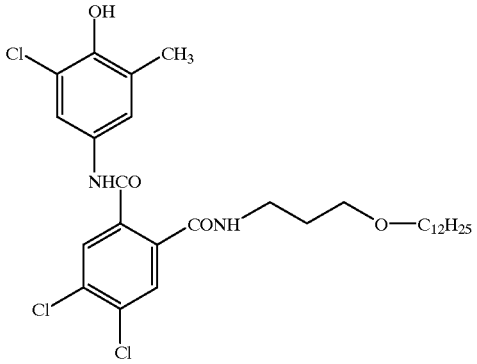
D-26
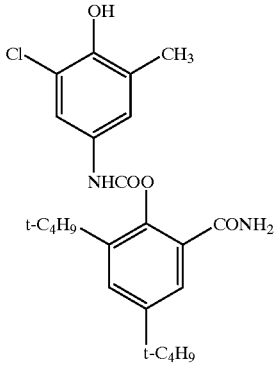
D-27
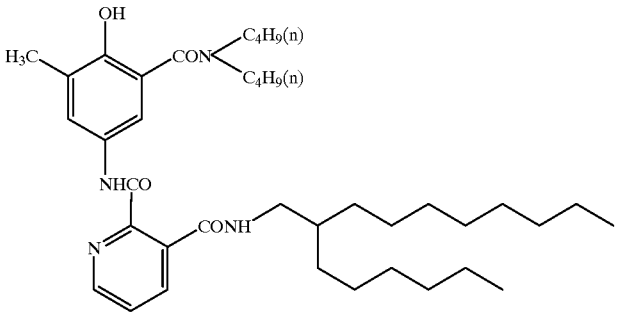

-continued
D-28
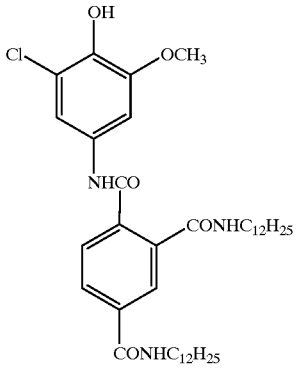
D-29
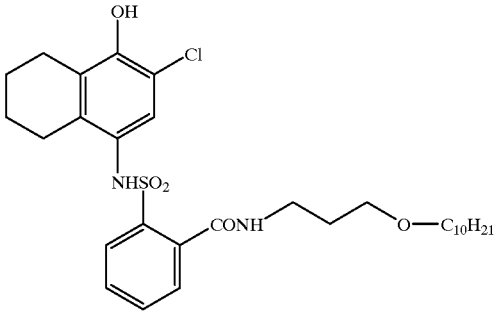
D-30
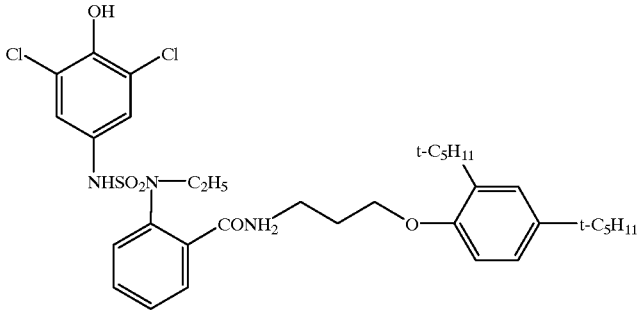
D-31
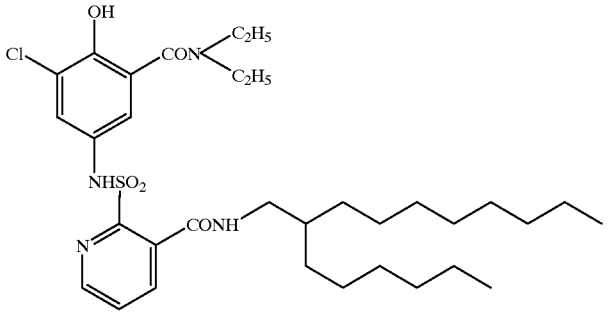

-continued
D-32
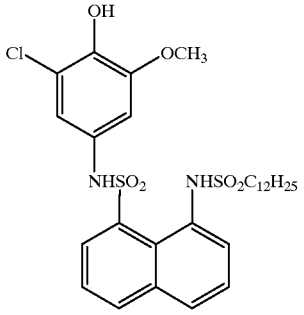
D-33
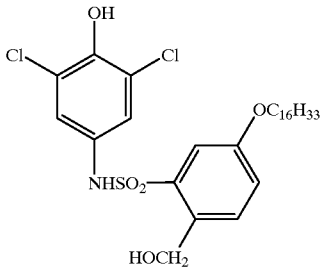
D-34
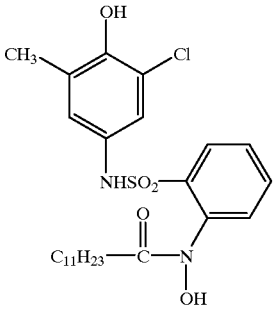
D-35
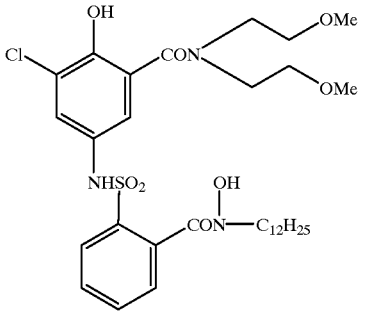
D-36
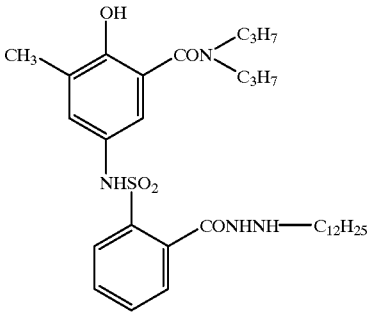

-continued

D-37

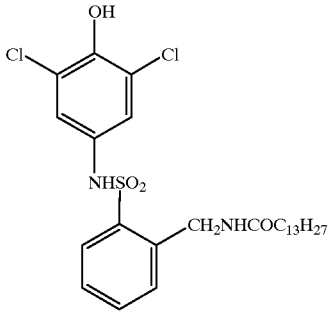

D-38

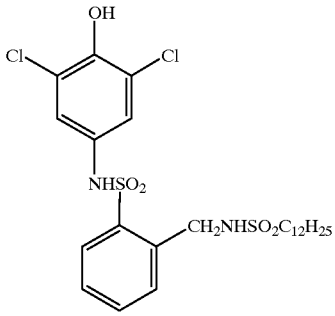

In the present invention, as a dye donative compound, there is used a compound (coupler) which forms a dye by an oxidation coupling reaction. This coupler may be any of a 4-equivalent coupler and 2-equivalent coupler, and the developing agent represented by the above-described general formula (1) can react with any coupler to form a dye.

Details of the above-described coupler including both 4-equivalent and 2-equivalent forms are described, for example, in T. H. James, The Theory of the Photographic Process, 4th edition, Macmillan, 1977, pp. 291–334, pp. 354–361, and in JP-A Nos. 58-12,353, 58-149,046, 58-149,047, 59-11,114, 59-124,399, 59-174,835, 59-231,539, 59-231,540, 60-12,951, 60-14,242, 60-23,474, 60-66,249 and the like.

Examples of the coupler preferably used in the present invention may include compounds having structures described in the following general formulae (2) to (13) These are compound generally called active methylene, pyrazolone, pyrazoloazole, phenol, naphthol or pyrrolotriazole respectively, and well known in the art.

(2)

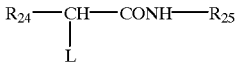

(3)

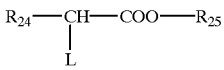

(4)

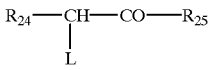

(5)

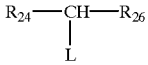

-continued (6)

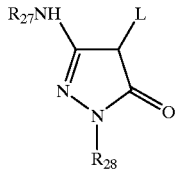

(7)

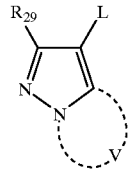

(8)

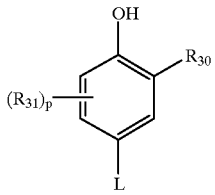

(9)

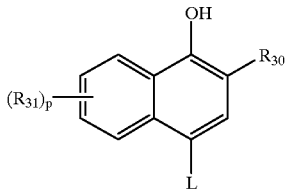

-continued (10)

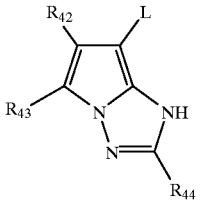

(11)

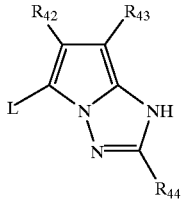

(12)

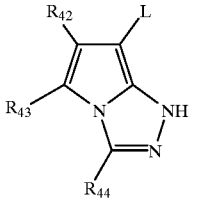

(13)

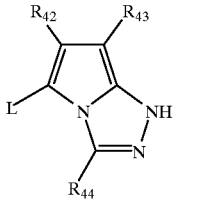

The compounds represented by the general formulae (2) to (5) are couplers each called as an active methylene type coupler. In these general formulae, $R_{24}$ represents an acyl group, cyano group, nitro group, aryl group, hetero cyclic group, alkoxycarbonyl group, aryloxycarbonyl group, carbamoyl group, sulfamoyl group, alkylsulfonyl group or arylsulfonyl group which may have a substituent, respectively.

In the compounds represented by the general formulae (2) to (5), $R_{26}$ represents an alkyl group, aryl group or hetero cyclic group which may have a substituent, respectively.

In the general formula (5), $R_{26}$ represents an aryl group or hetero cyclic group which may have a substituent, respectively.

Examples of the substituent that $R_{24}$, $R_{25}$ and $R_{26}$ may include various substituents such as an alkyl group, alkenyl group, alkynyl group, aryl group, hetero cyclic group, alkoxy group, aryloxy group, cyano group, halogen atom, acylamino group, sulfonamide group, carbamoyl group, sulfamoyl group, alkoxycarbonylgroup, aryloxydarbonylgroup, alkylamimogroup, arylamino group, hydroxy group, sulfo group and the like.

Preferable examples of $R_{24}$ may include an acyl group, cyano group, carbamoyl group and alkoxycarbonyl group.

In the compounds represented by the general formulae (2) to (5), L is a group which can be released by a coupling reaction with a hydrogen atom or a developing agent oxidation product.

Specific examples of L may include a carboxyl group, formyl group, halogen atom (such as bromine, iodine), carbamoyl group, methylene group having a substituent (the substituent is selected from an aryl group, sulfonamide group, carbonamide group, alkoxy group, amino group, hydroxy group and the like), acyl group, sulfo group, alkoxy group, aryloxy group, alkylthio group, arylthio group, alkylsulfinyl group, arylsulfinyl group, alkylsulfonyl group, arylsulfonyl group, acyloxy group, alkoxycarbonyloxy group, aryloxycarbonyloxy group, carbamoyloxy group, sulfamoyloxy group, N-substituted hetero cyclic group and the like. Among them, releasing groups especially having a halogen atom, S atom or O atom as a releasing atom are particularly preferable.

In the compounds represented by the general formulae (2) to (5), $R_{24}$ and $R_{25}$ may be linked each other to form a ring and $R_{24}$ and $R_{26}$ may be linked each other to form a ring.

The compound represented by the general formula (6) is a coupler referred to as a 5-pyrazolone-based magenta coupler.

In the general formula (6), $R_{27}$ represents an alkyl group, aryl group, acyl group or carbamoyl group. $R_{28}$ represents a phenyl group or a phenyl group having one or more substituents selected from a halogen atom, alkyl group, cyano group, alkoxy group, alkoxycarbonyl group and acylamino group. L has the same definitions as defined in the compounds represented by the general formulae (2) to (5).

In the 5-pyrazolone-based magenta coupler represented by the general formula (6), $R_{27}$ is preferably an aryl group or acyl group, and $R_{28}$ is preferably a phenyl group having one or more substituents selected from halogen atoms.

Preferable examples of $R_{27}$ may include aryl groups such as a phenyl group, 2-chlorophenyl group, 2 -methoxyphenyl group, 2-chloro-5-tetradecanamidephenyl group, 2-chloro-5-(3-octadecenyl-1-succinimide)phenyl group, 2-chloro-5octadecylsulfonamidephenyl group, 2-chloro-5-[2-(4-hydroxy3-t-butylphenoxy)tetradecanamine]phenyl and the like, acyl groups such as an acetyl group, pivaloyl group, tetradecanoyl group, 2-(2,4-di-t-pentylphenoxy)acetyl group, 2-(2,4-di-t-pentylphenoxy)butanoyl group, benzoyl group, 3-(2,4-di-t-amylphenoxyacetoazide)benzoyl group, and the like, and these groups may further have a substituent, and this substituent is an organic substituent or halogen atom which is connected via a carbon atom, oxygen atom, nitrogen atom or sulfur atom.

$R_{28}$ preferably may include a substituted phenyl group such as 2,4,6-trichlorophenyl group, 2,5-dichlorophenyl group, 2-chlorophenyl group and the like.

The compound represented by the general formula (7) may be a coupler referred to as a pyrazoloazole-based coupler.

In the general formula (7), $R_{29}$ represents a hydrogen atom or a substituent. V represents a non-metal atom group required for forming 5-membered azole ring containing 2 to 4 nitrogen atoms, and the azole ring may have a substituent (including condensed ring). L has the same definitions as defined in the compound represented by the general formulae (2) to (5).

Among the pyrazoloazole-based couplers represented by the general formula (7), imidazo[1,2-b]pyrazoles described in U.S. Pat. No. 4,500,630, pyrazolo[1,5-b][1,2,4]triazoles described in U.S. Pat. No. 450,654 and pyrazolo[5,1-c][1,2,4]triazoles described in U.S. Pat. No. 3,725,067 are preferable in the point of absorption property of a color developing dye, and among them pyrazolo[1,5-b][1,2,4]triazoles are preferable in the point of light fastness.

The details of substituents on an azole ring represented by $R_{29}$, L and V are described, for example, in U.S. Pat. No. 4,540,654, 2nd column, lines 41 to 8th column, line 27.

Preferable examples thereof may include a pyrazoloazole coupler in which a branched alkyl group directly bonds to the 2, 3 or 6-position of a pyrazolotriazole group described in JP-A No. 61-65,245, a pyrazoloazole coupler containing a sulfoneamide group in the molecule described in JP-A No. 61-65,245, a pyrazoloazole coupler having an alkoxyphenylsulfonamide ballast group described in JP-A No. 61-147,254, apyrazoloazole coupler having an alkoxy group and aryloxy group in the 6-position described in JP-A No. 62-209,457 or 63-307,453, and a pyrazoloazole coupler having a carbonamide group in the molecule described in JP-A No. 2-201,443.

The compound represented by the general formula (8) and the compound represented by the general formula (9) are couplers referred to as a phenol-based coupler and naphthol-based coupler, respectively.

In these general formulae, $R_{30}$ represents a hydrogen atom or a group selected from $—NHCOR_{32}$, $—SO_2NR_{32}R_{33}$, $—NHSO_2R_{32}$, $—NHCOR_{32}$, $—NHCONR_{32}R_{33}$ and $—NHSO_2NR_{32}R_{33}$. $R_{32}$ and $R_{33}$ represent a hydrogen atom or a substituent. $R_{31}$ represents a substituent, p represents an integer selected from 0 to 2, and m represents an integer selected from 0 to 4. L has the same definitions as defined in compounds represented by the general formulae (2) to (5). $R_{31}$ to $R_{33}$ have the same definitions as defined in the substituents of the $R_{24}$ to $R_{26}$.

Preferable examples of the phenol-based coupler represented by the formula (8) may include 2-alkylamino-5-alkylphenol-based couplers described in U.S. Pat. Nos. 2,369,929, 2,801,171, 2,772,162, 2,895,826, 3,772,002 and the like, 2,5-dialkylaminophenol-based couplers described in U.S. Pat. Nos. 2,772,162, 3,758,308, 4,126,396, 4,334,011, 4,327,173, OLS 3,329,729, JP-A No. 59-166956 and the like, 2-phenylureido5-acylaminophenol-based couplers described in U.S. Pat. Nos. 3,446,622, 4,333,999, 4,451,559, 4,427,767, and the like.

Preferable examples of the naphthol coupler represented by the formula (9) may include 2-carbamoyl-1-naphtol-based couplers described in U.S. Pat. Nos. 2,474,293, 4,052,212, 4,146,396, 4,228,233, 4,296,200 and the like, as well as 2-carbamoyl-5-amide-1-naphtol-based couplers described in U.S. Pat. No. 4,690,889, and the like.

The compounds represented by the general formulae (10) to (13) are couplers each referred to as pyrrolotriazole.

In these general formulae, $R_{42}$, $R_{43}$ and $R_{44}$ represent a hydrogen atom or a substituent. L has the same definitions as defined in the compounds represented by the general formulae (2) to (5). The substituents of $R_{42}$, $R_{43}$ and $R_{44}$ have the same definitions as for the substituents of $R_{24}$ to $R_{26}$.

Preferable examples of the pyrrolotriazole-based couplers represented by the general formulae (10) to (13) may include couplers in which at least one of $R_{42}$ and $R_{43}$ is an electron attractive group described in EP 488,248A1, 491,197A1 and 545,300.

In the present invention, in addition to the above-described couplers, there can be used couplers having different structure such as condensed ring phenol-based couplers, imidazole-based couplers, pyrrole-based couplers, 3-hydroxypyridine-based couplers, active methine-based couplers, 5,5-condensed ring heterocyclic-based couplers and 5,6-condensed ring heterocyclic-based couplers.

As the condensed phenol-based coupler, there can be used couplers described in U.S. Pat. Nos. 4,327,173, 4,564,586, 4,904,575 and the like.

As the imidazole-based coupler, there can be used couplers described in U.S. Pat. Nos. 4,818,672, 5,051,347 and the like.

As the pyrrole-based coupler, there can be used couplers described in JP-A Nos. 4-188,137, 4-190,347 and the like.

As the 3 -hydroxypyridine-based coupler, there can be used couplers described in JP-A No. 1-315,736 and the like.

As the active methine-based coupler, there can be used couplers described in U.S. Pat. Nos. 5,104,783, 5,162,196 and the like.

As the 5,5-condensed ring heterocyclic-based couplers, there can be used pyrrolopyrazole-based couplers described in U.S. Pat. No. 5,164,289, pyrroloimidazole-based couplers described in JP-A No. 4-174,429, and the like.

As the 5,6-condensed ring heterocyclic-based couplers, there can be used pyrazolopyrimidine-based couplers described in U.S. Pat. No. 4,950,585, pyrrolotriazine-based couplers described in JP-A No. 4-204,730, couplers described in EP No. 556,700, and the like.

In the present invention, in addition to the above-described couplers, there can be used couplers described in German Patent Nos. 3,819,051A, 3,823,049, U.S. Pat. Nos. 4,840,883, 5,024,930, 5,051,347, 4,481,268, EP Nos. 304,856A2, 329,036, 354,549A2, 374,781A2, 379,110A2, 386,930A1, JP-A Nos. 63-141,055, 64-32,260, 32,261,2-297,547, 2-44,340,2-110,555, 3-7,938, 3-160,440, 3-172,839, 4-172,447, 4-179,949, 4-182,645, 4-184,437, 4-188,138, 4-188,139, 4-194,847, 4-204,532, 4-204,731, 4-204,732, and the like.

Specific example of the couplers which can be used in the present invention may include, but not limited to, the following couplers C-1 to C-199. These couplers are arranged in the order of a 4-equivalent coupler and a 2-equivalent coupler. Regarding the 2-equivalent coupler, those used for a diffusion transfer type light-sensitive material in which a is a releasing group are also described.

Specific examples of 4-equivalent coupler

C-1

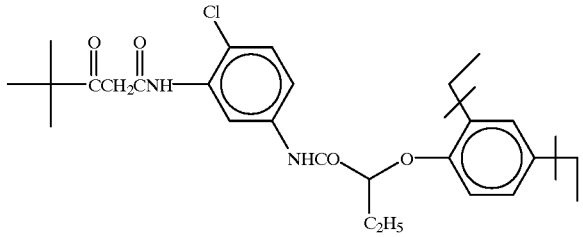

-continued
C-2
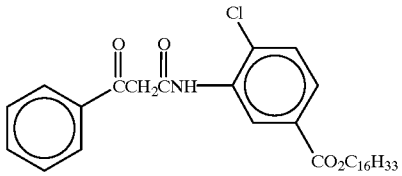
C-3
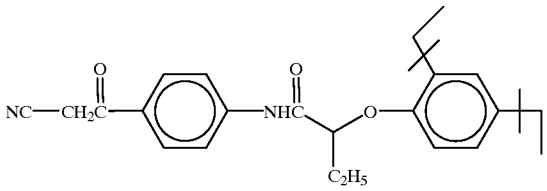
C-4
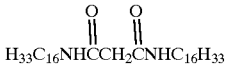
C-5
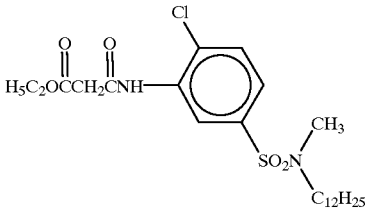
C-6
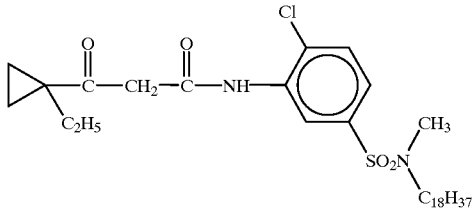
C-7
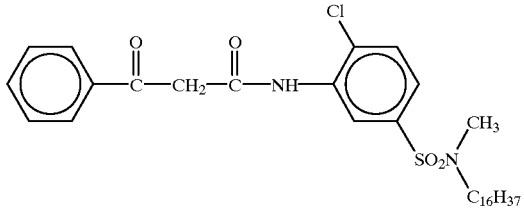
C-8
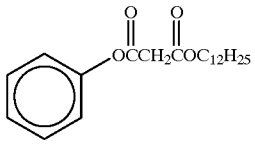
C-9
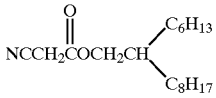

-continued
C-10
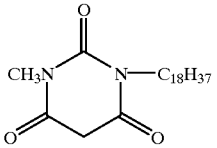
C-11
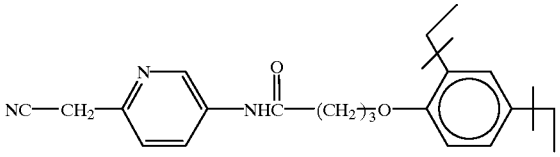
C-12
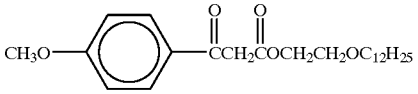
C-13
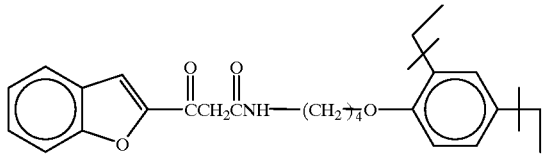
C-14
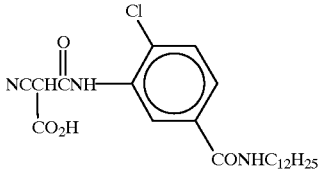
C-15
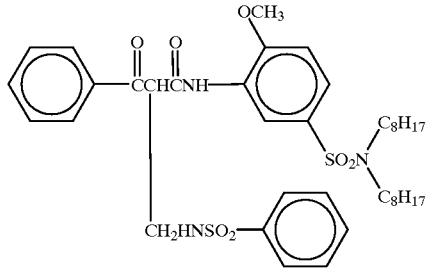
C-16
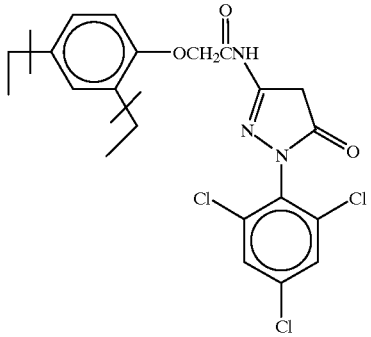

-continued
C-17
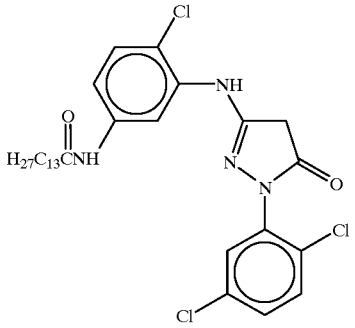
C-18
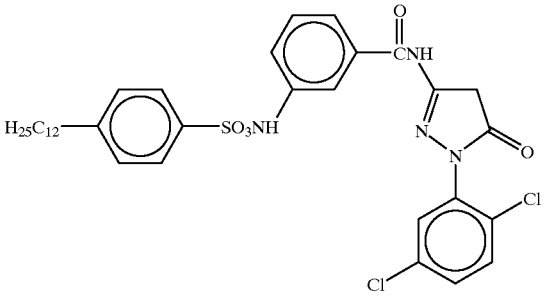
C-19
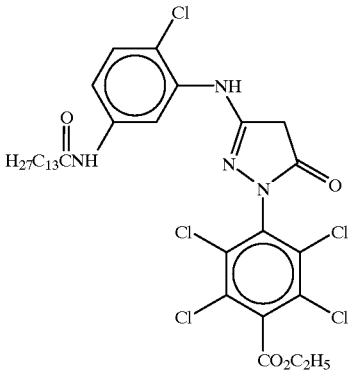
C-20
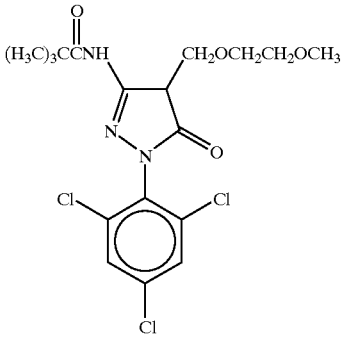

-continued
C-21
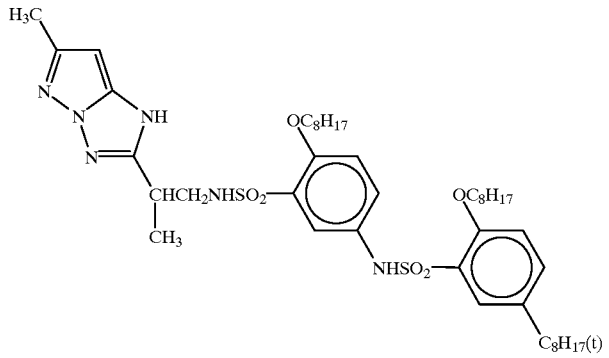
C-22
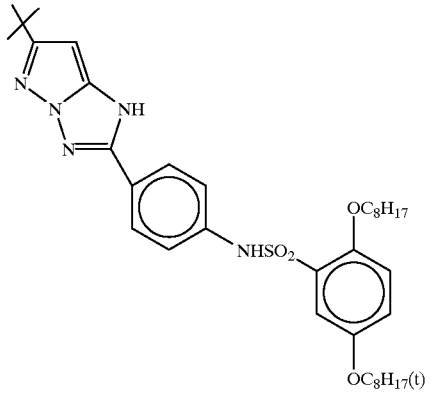
C-23
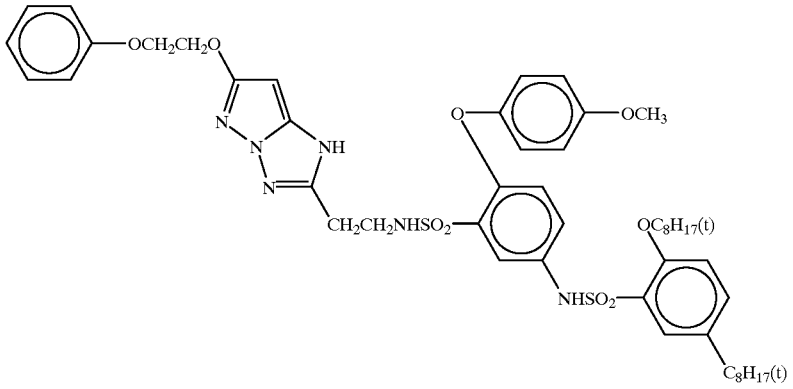
C-24
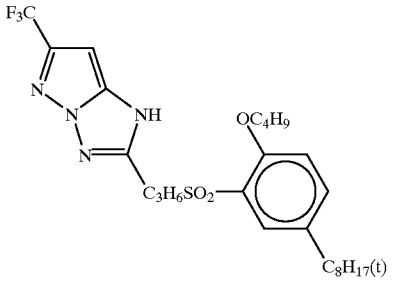

-continued
C-25
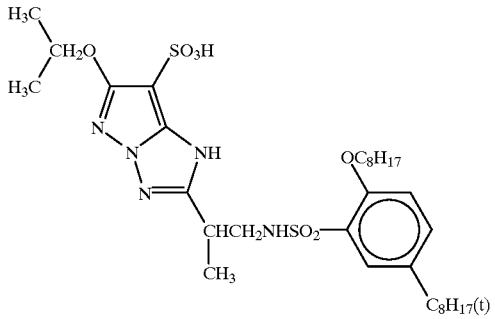
C-26
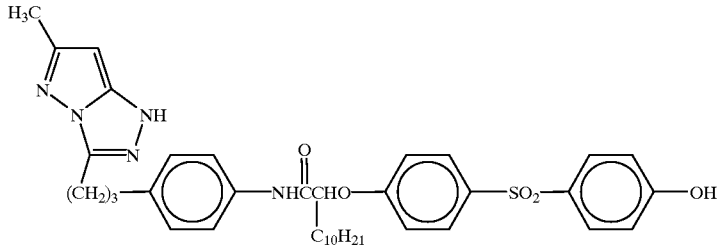
C-27
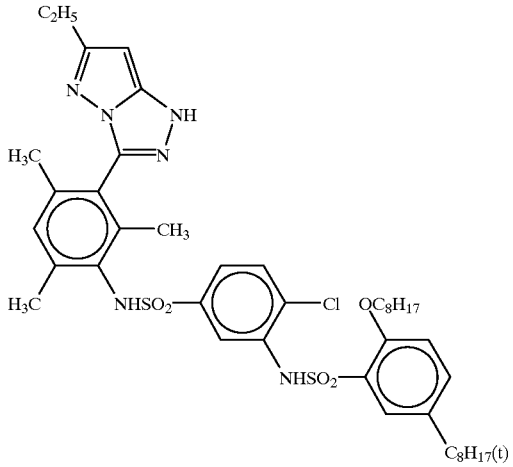
C-28
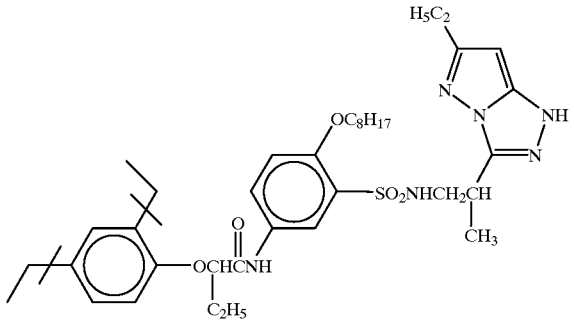

-continued
C-29
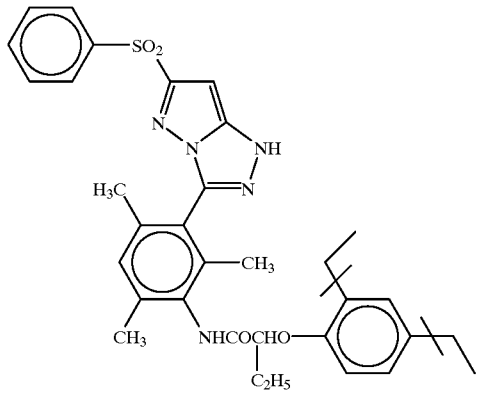
C-30
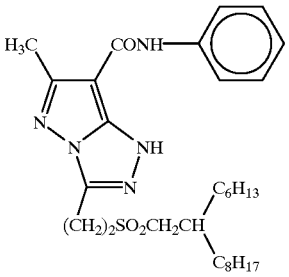
C-31
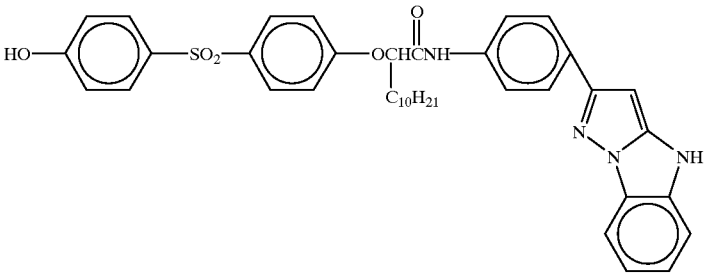
C-32
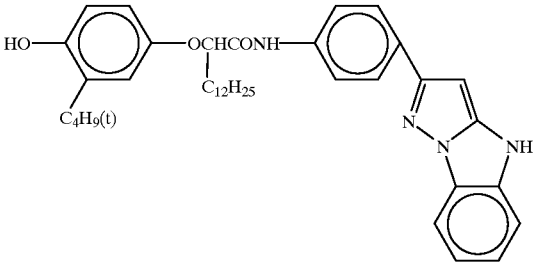
C-33
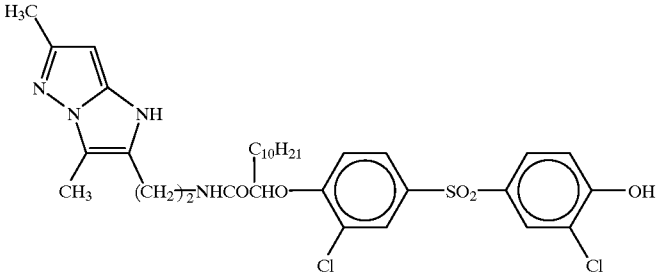

-continued
C-34
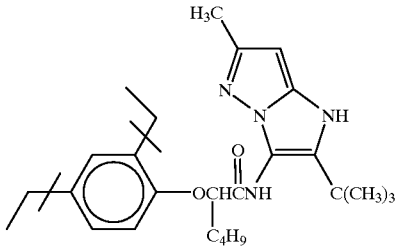
C-35
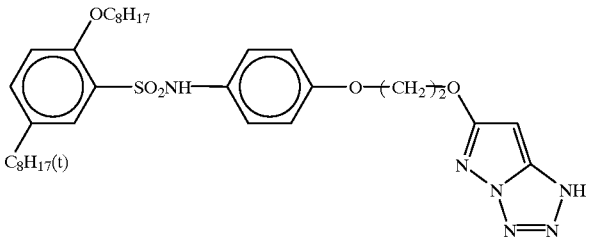
C-36
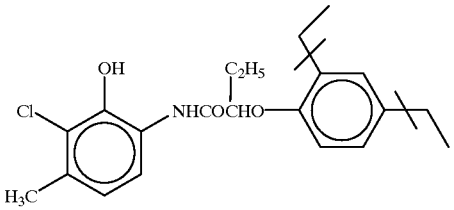
C-37
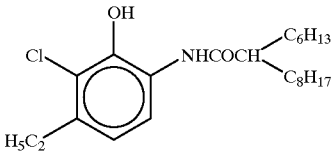
C-38
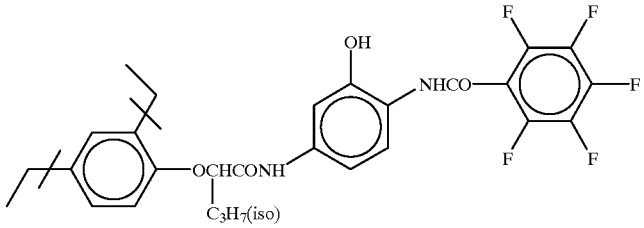
C-39
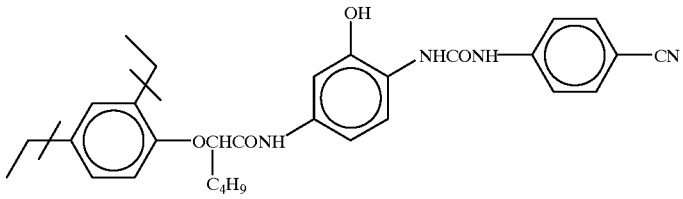

-continued
C-40
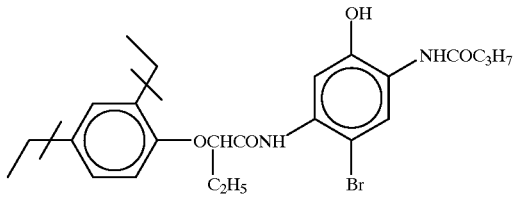
C-41
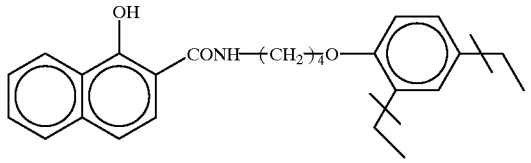
C-42
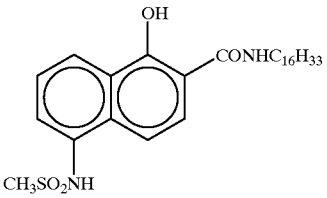
C-43
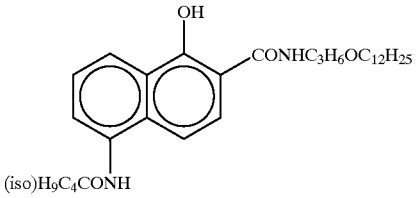
C-44
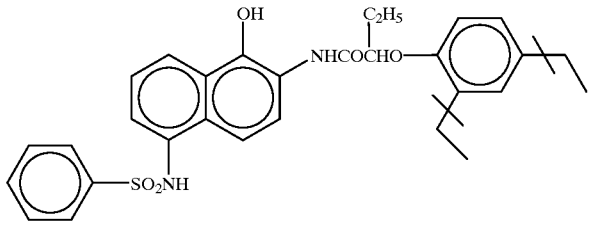
C-45
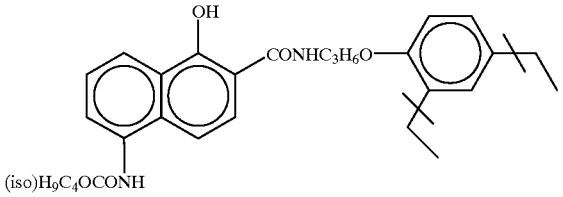
C-46
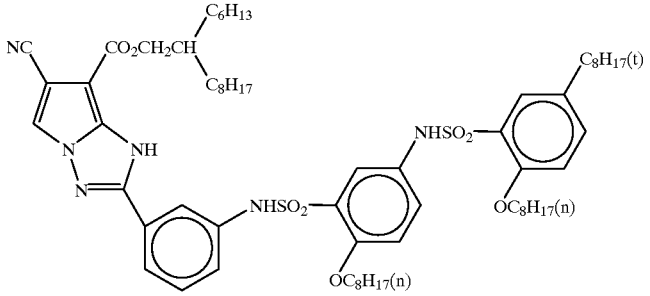

-continued
C-47
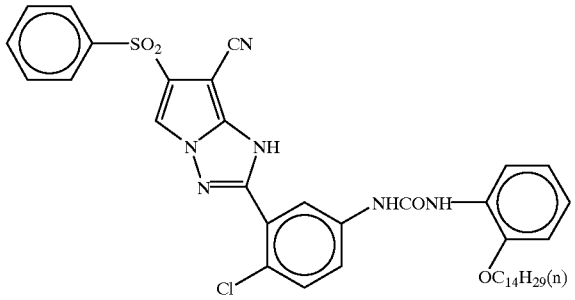
C-48
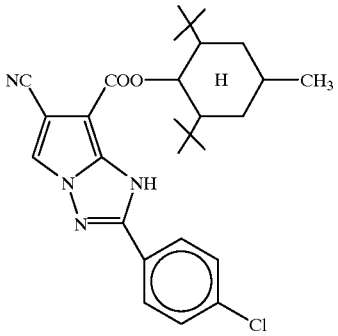
C-49
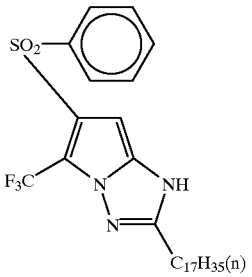
C-50
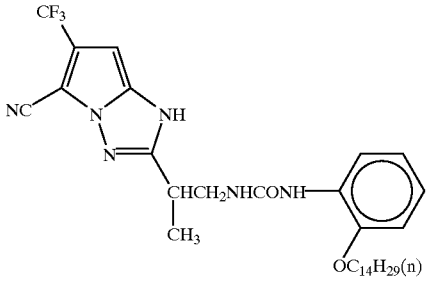
C-51
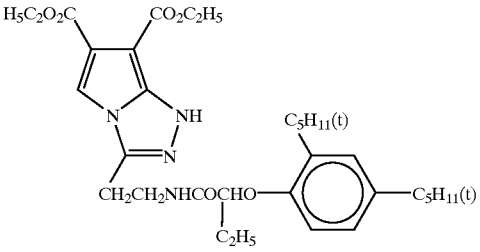

-continued
C-52
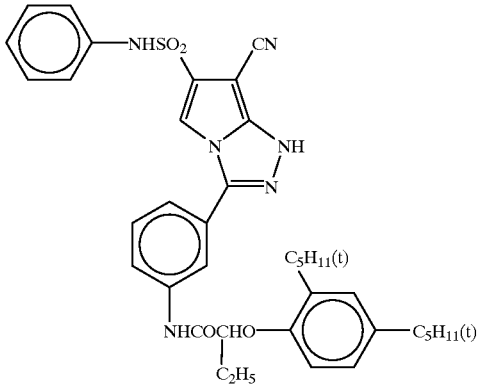
C-53
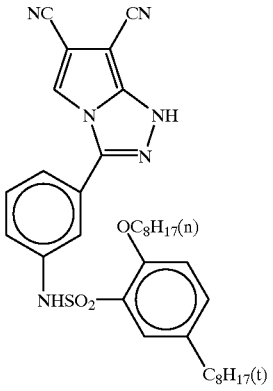
C-54
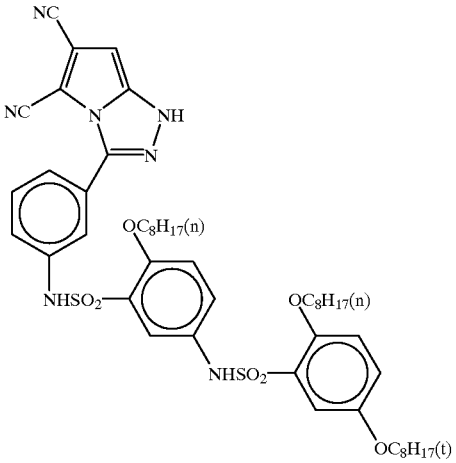
C-55
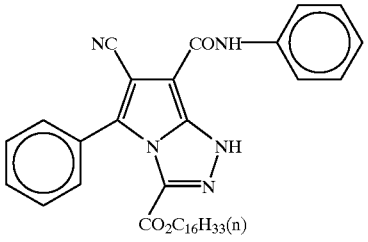

-continued
C-56
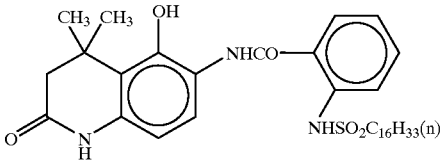
C-57
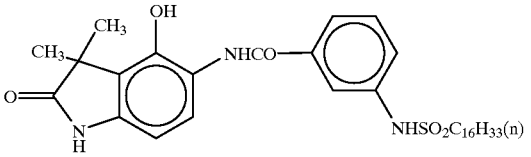
C-58
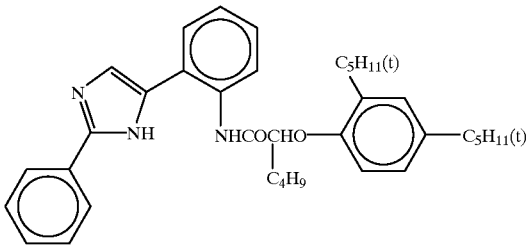
C-59
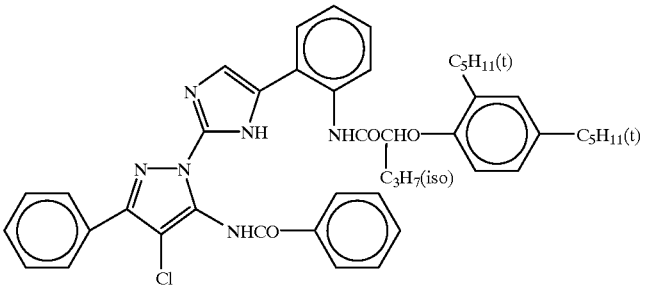
C-60
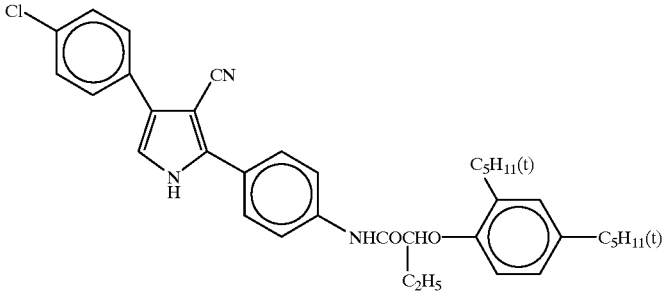
C-61
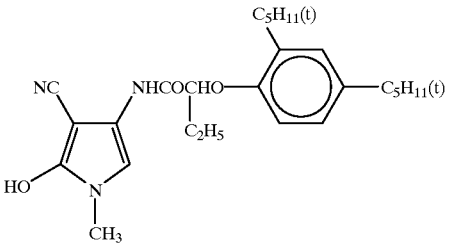

-continued
C-62
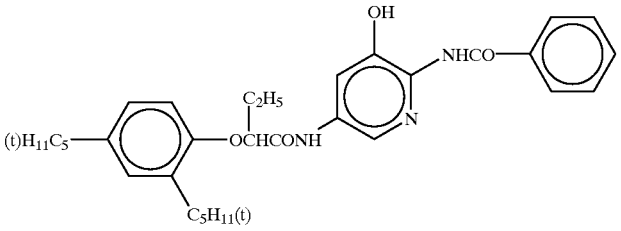
C-63
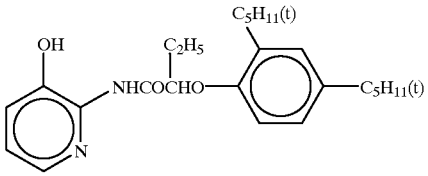
C-64
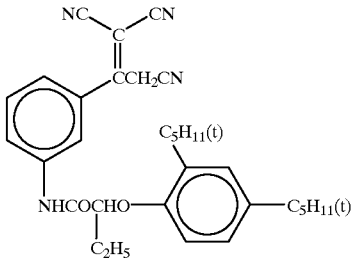
C-65
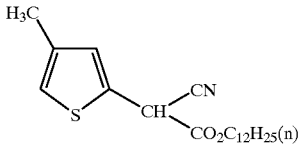
C-66
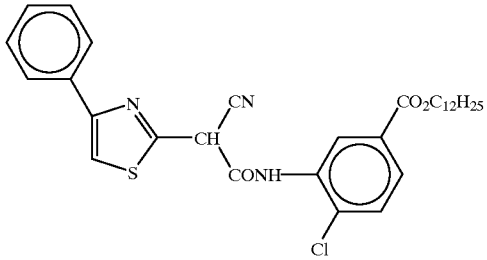
C-67
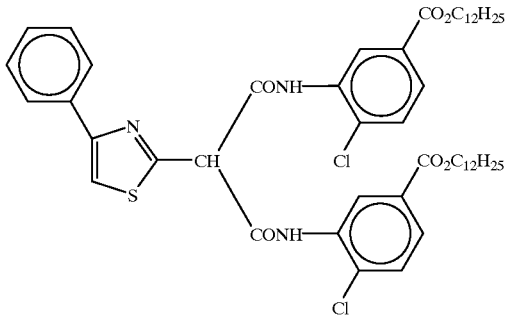

-continued
C-68
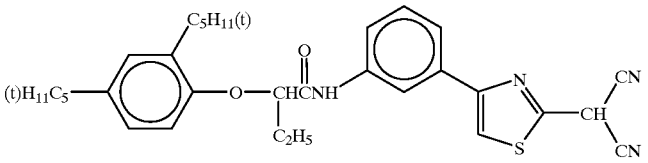
C-69
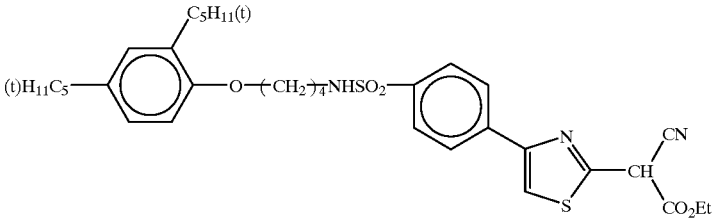
C-70
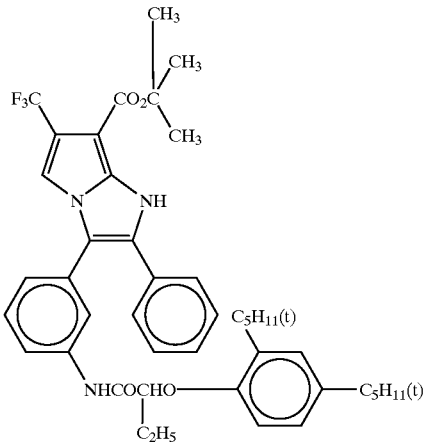
C-71
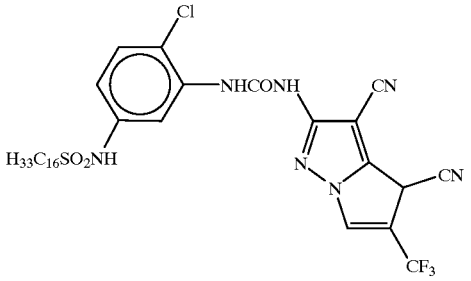
C-72
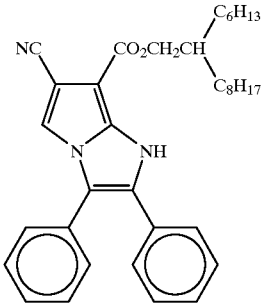

-continued
C-73
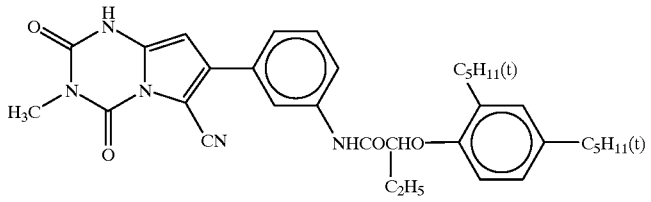
C-74
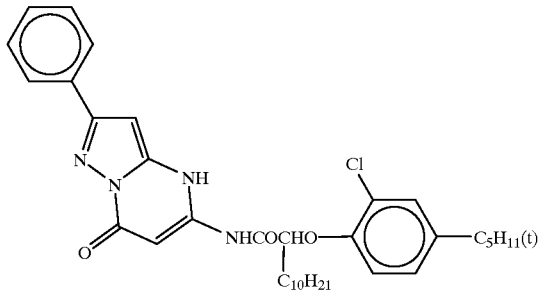
C-75
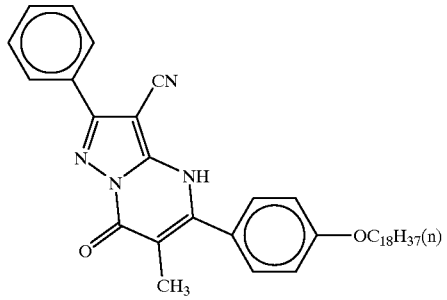
Specific examples of 2-equivalent coupler
C-76
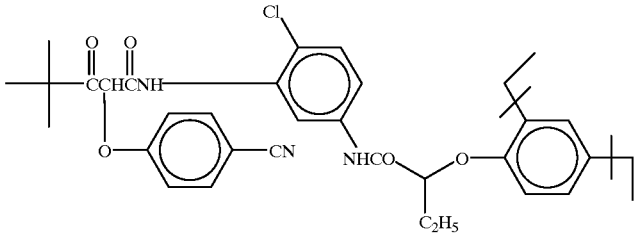
C-77
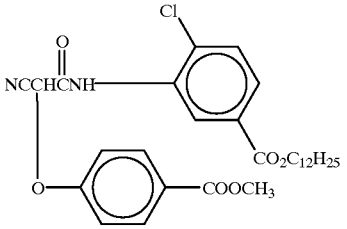

-continued
C-78
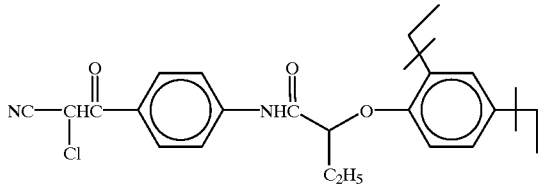
C-79
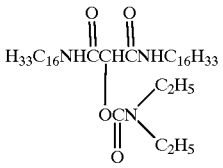
C-80
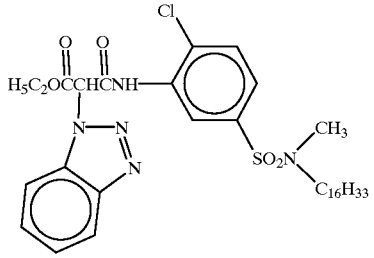
C-81
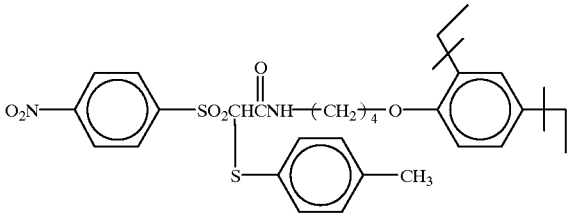
C-82
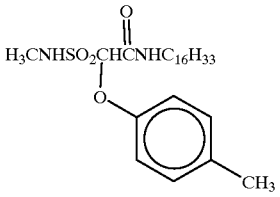
C-83
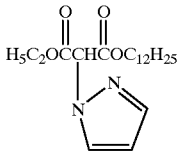
C-84
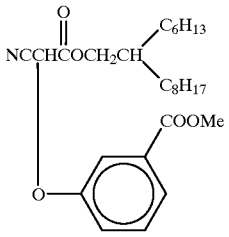

-continued
C-85
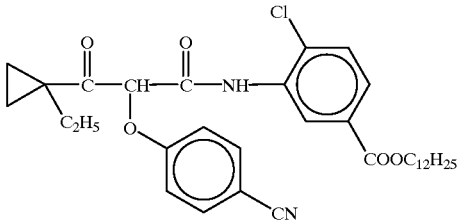
C-86
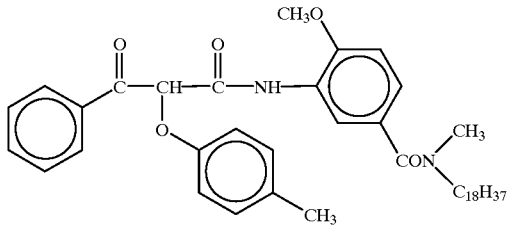
C-87
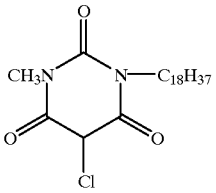
C-88
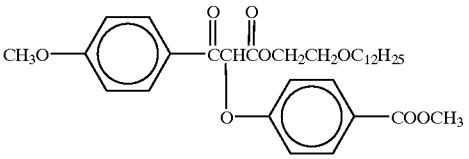
C-89
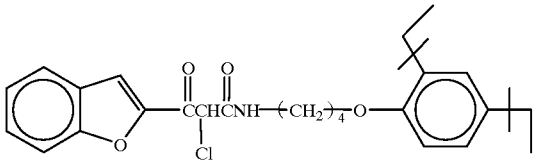
C-90
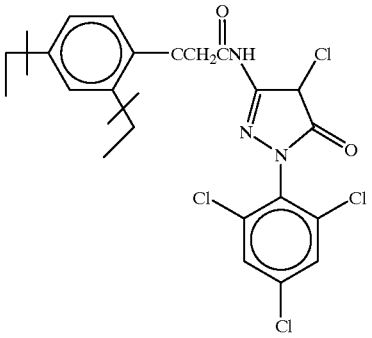

-continued
C-91
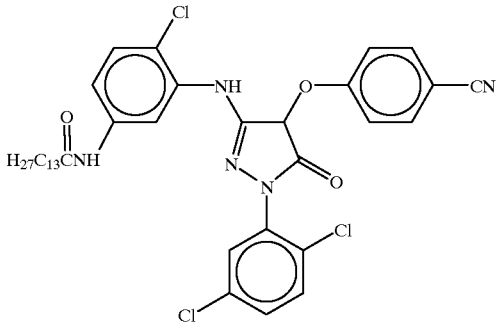
C-92
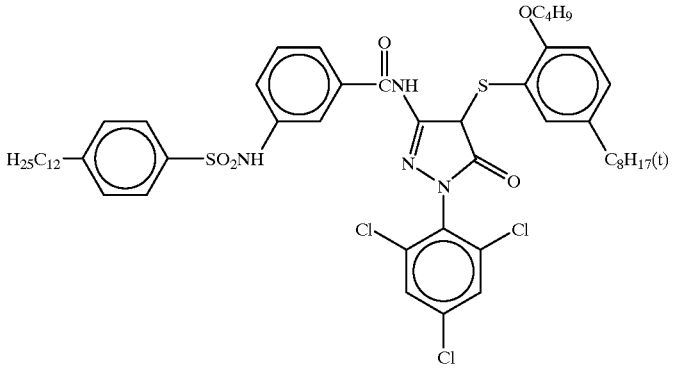
C-93
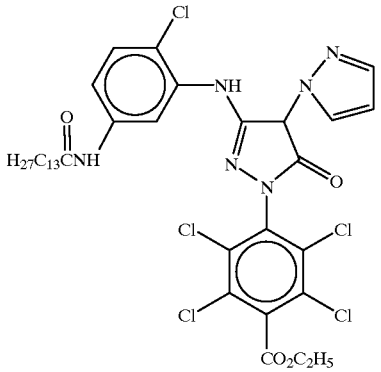
C-94
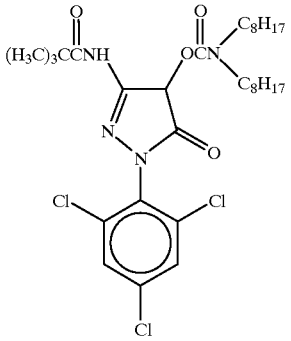

-continued
C-95
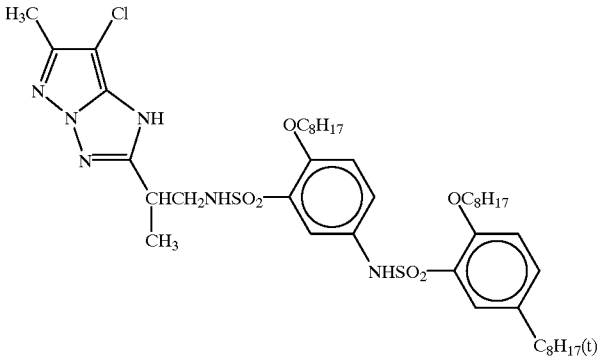
C-96
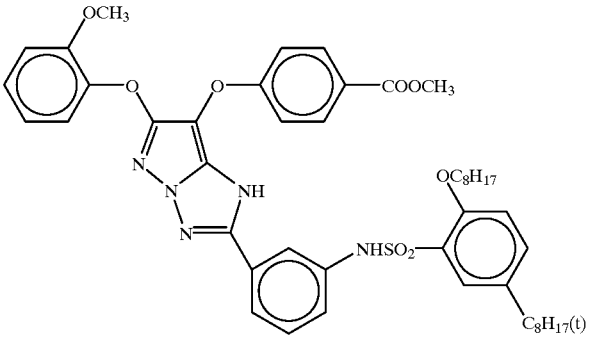
C-97
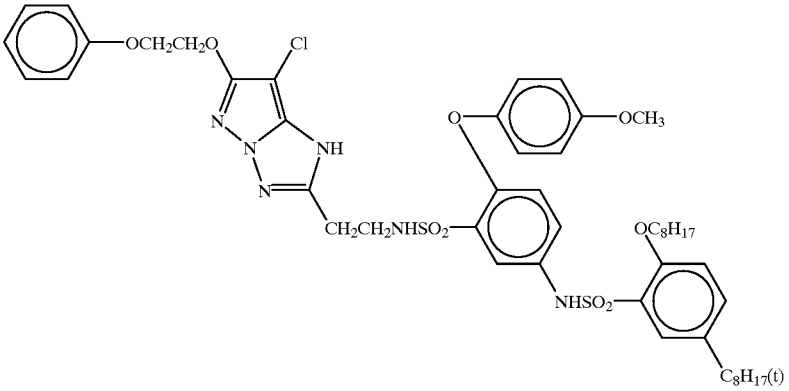
C-98
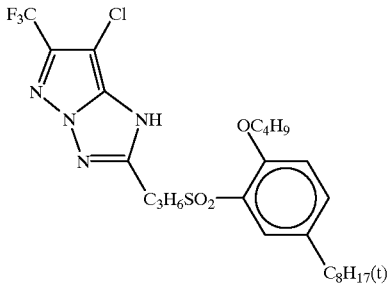

-continued
C-99
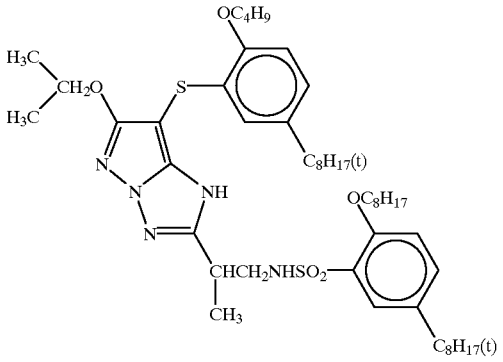
C-100
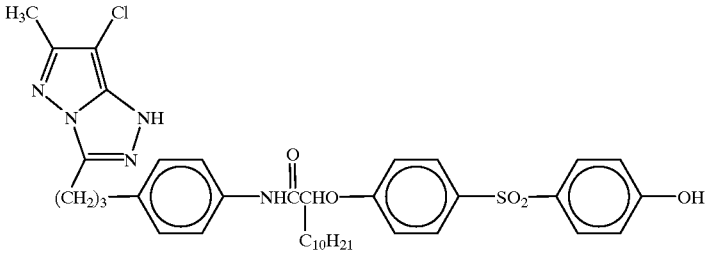
C-101
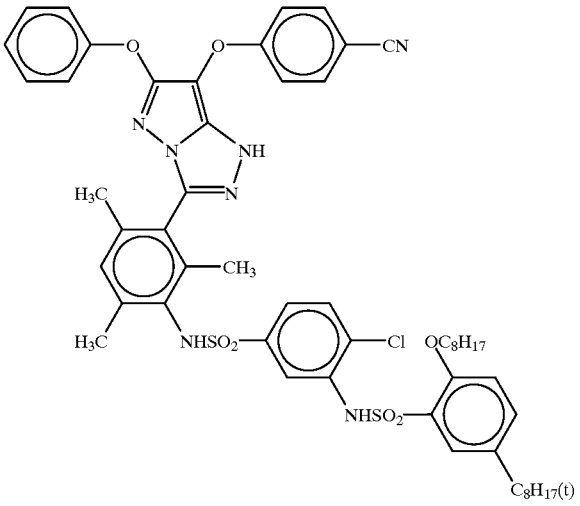
C-102
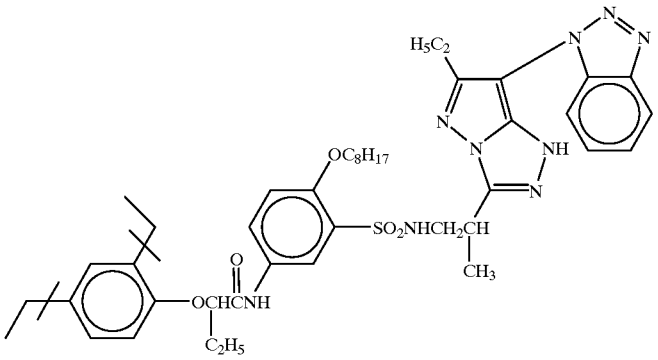

-continued
C-103
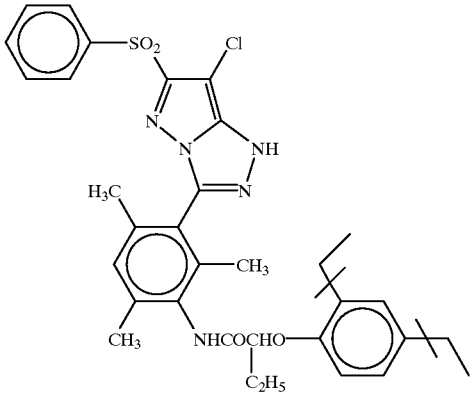
C-104
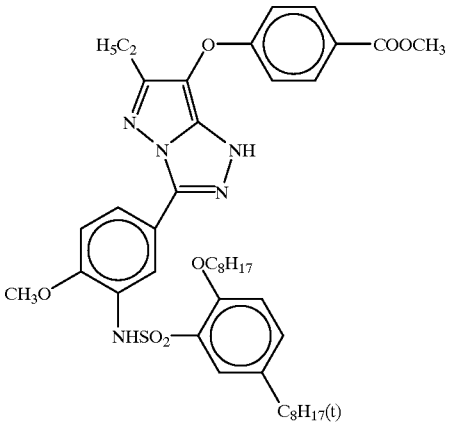
C-105
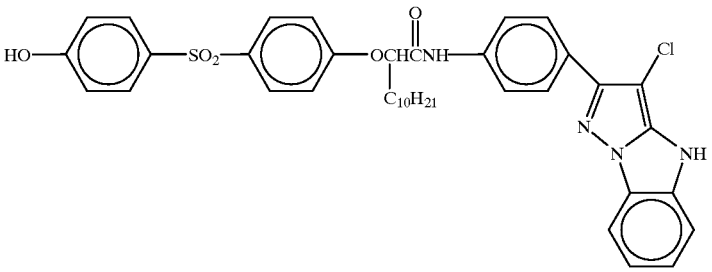
C-106
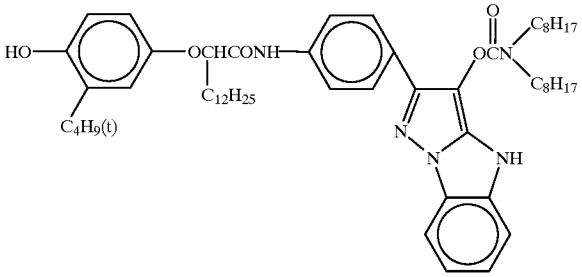

-continued
C-107
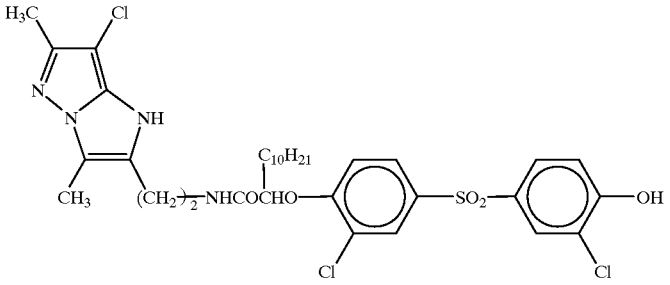
C-108
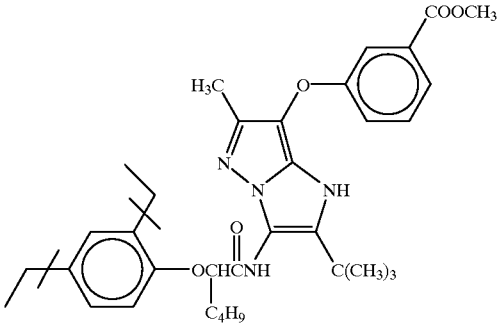
C-109
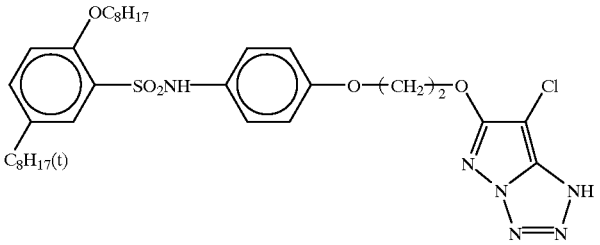
C-110
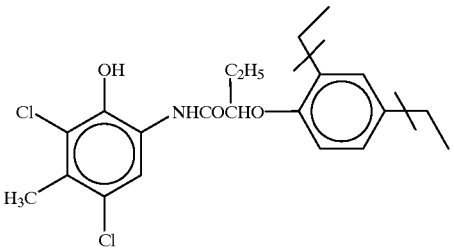
C-111
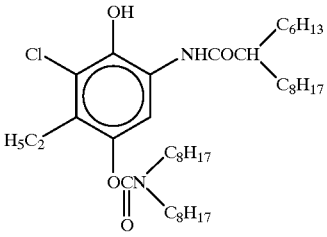

-continued
C-112
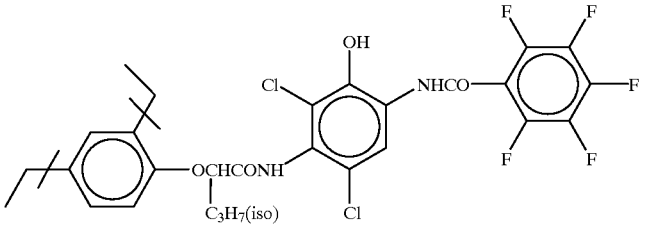
C-113
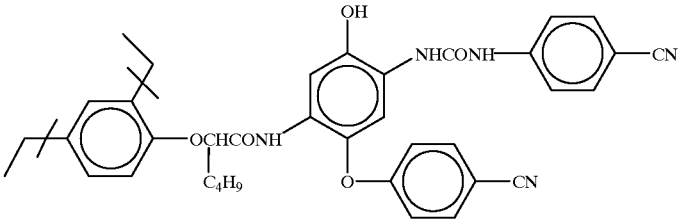
C-114
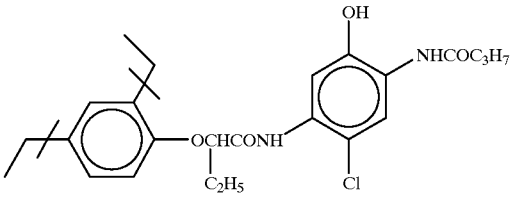
C-115
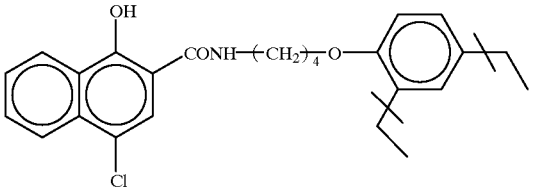
C-116
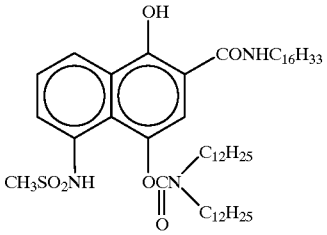
C-117
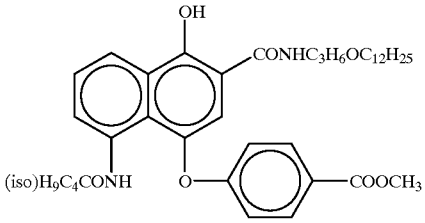

-continued
C-118
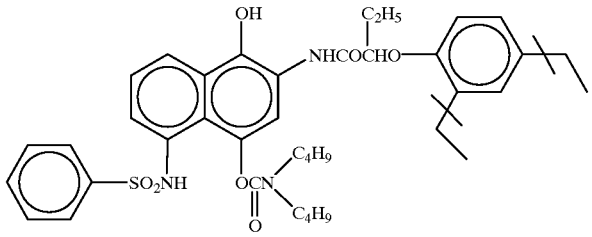
C-119
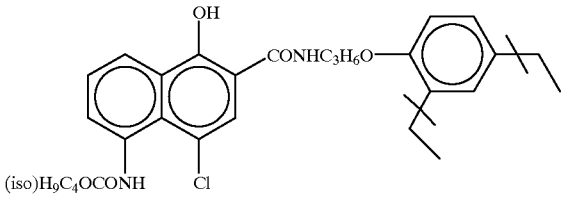
C-120
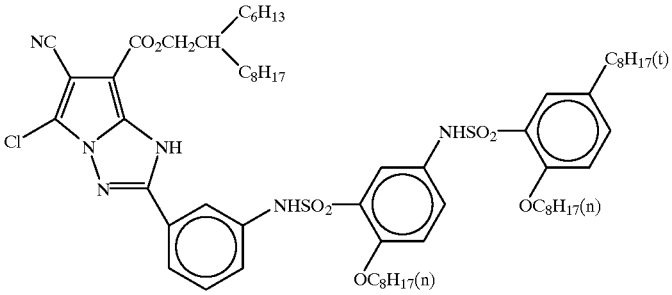
C-121
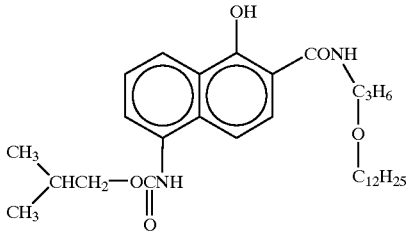
C-122
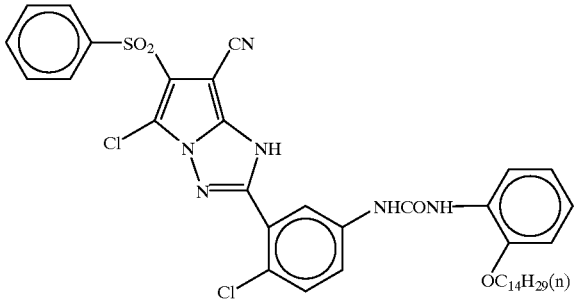

-continued
C-123
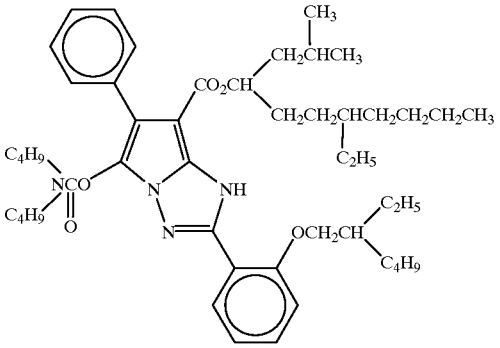
C-124
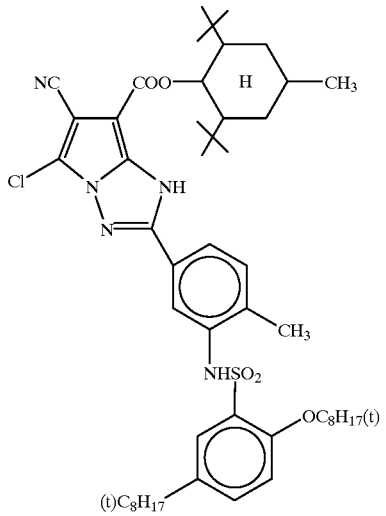
C-125
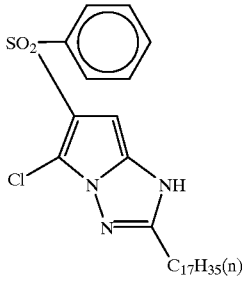
C-126
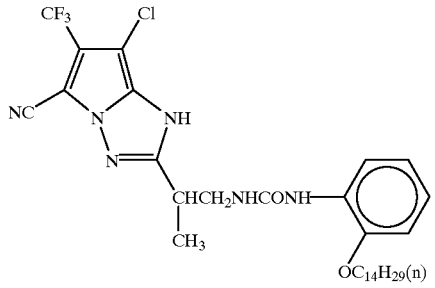

-continued
C-127
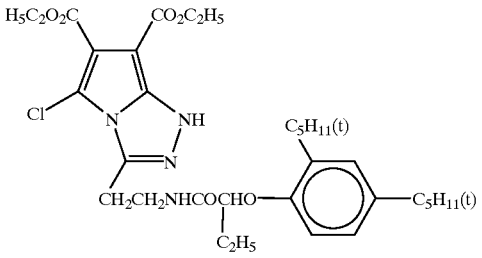
C-128
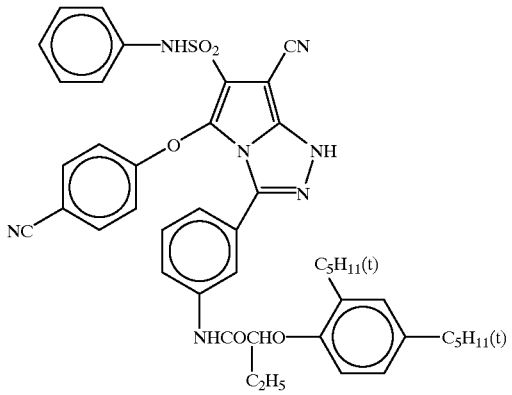
C-129
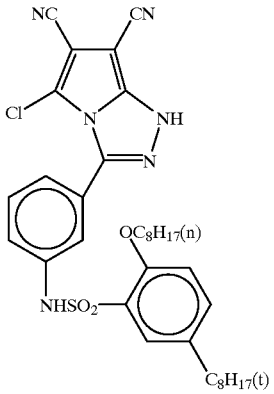
C-130
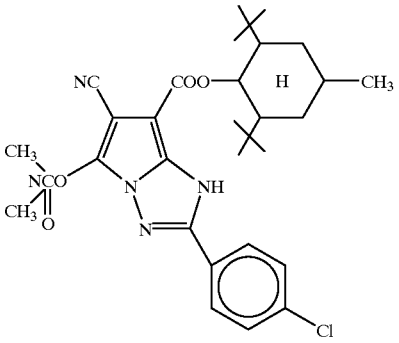

-continued
C-131
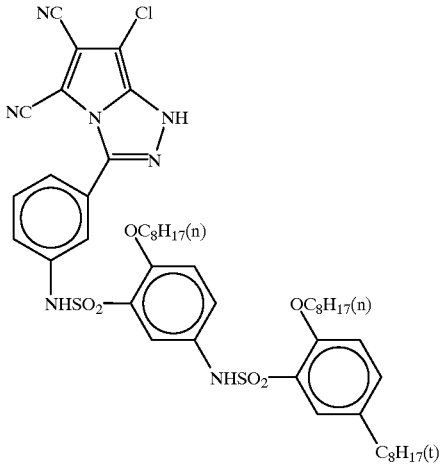
C-132
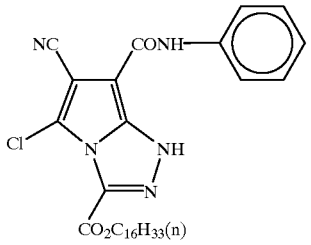
C-133
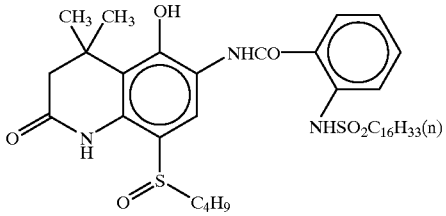
C-134
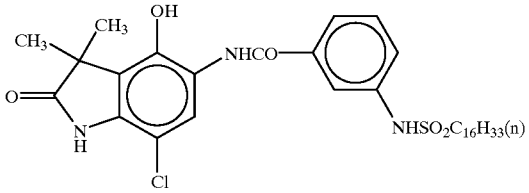
C-135
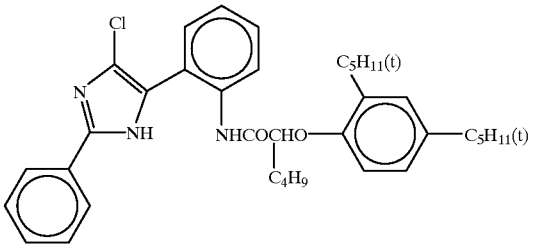

-continued
C-136
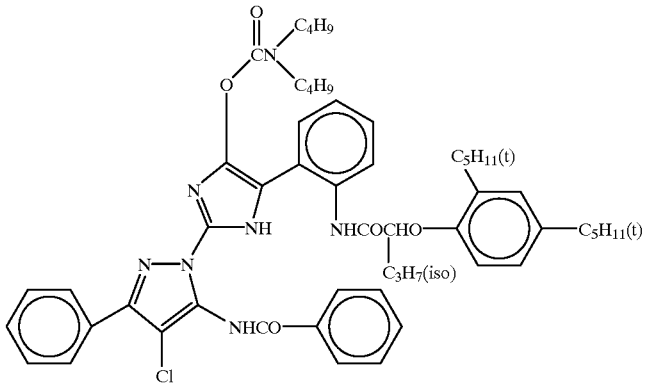
C-137
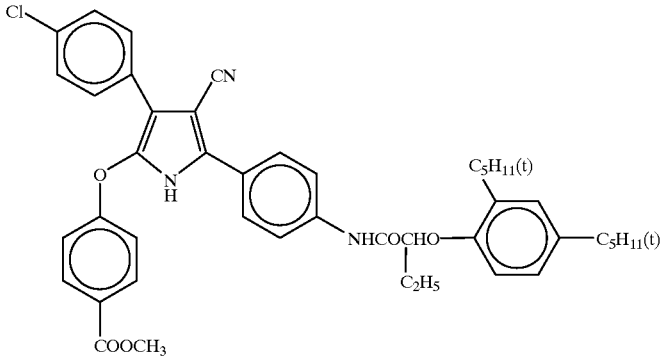
C-138
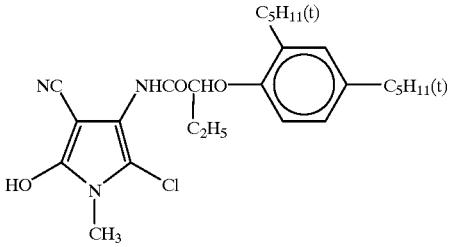
C-139
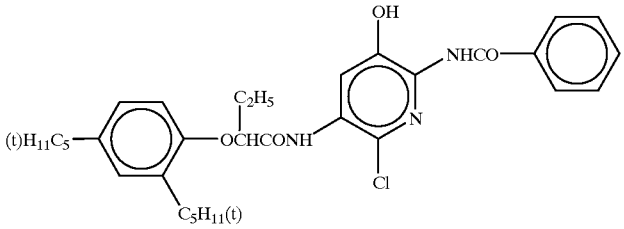
C-140
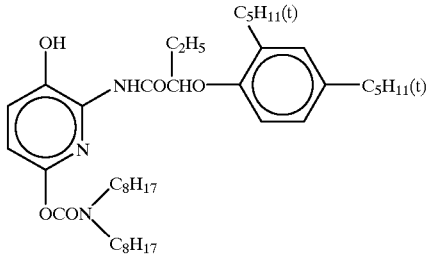

-continued
C-141
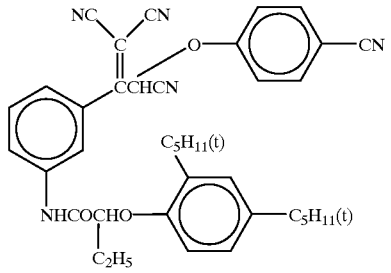
C-142
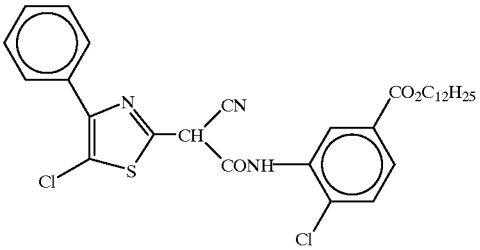
C-143
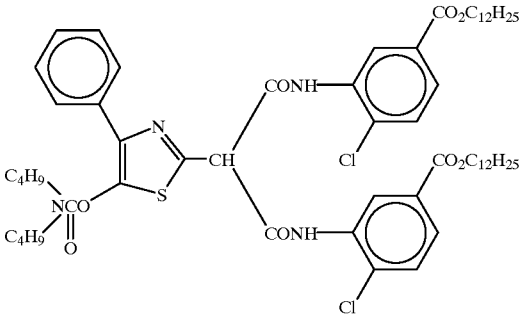
C-144
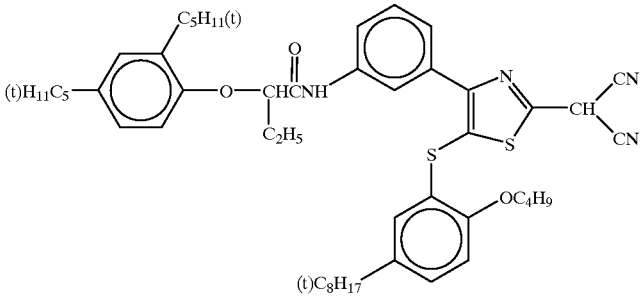
C-145
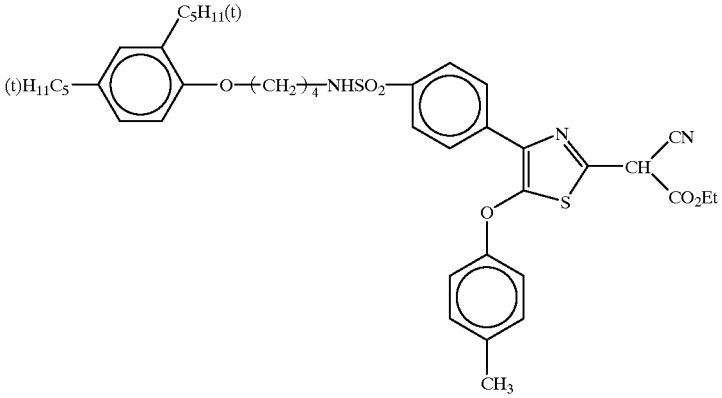

-continued
C-146
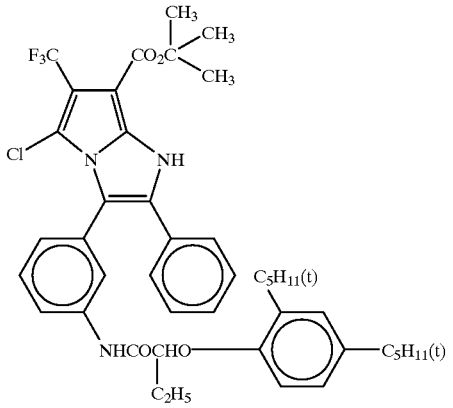
C-147
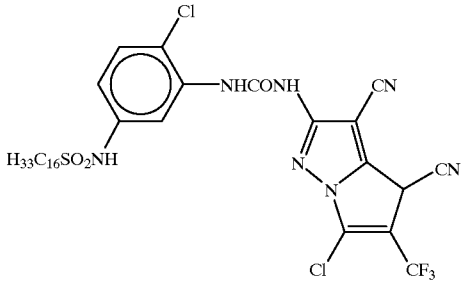
C-148
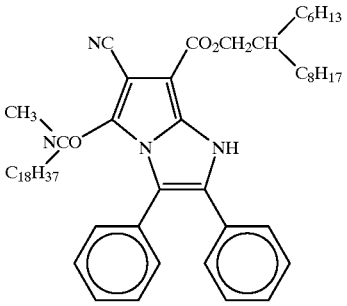
C-149
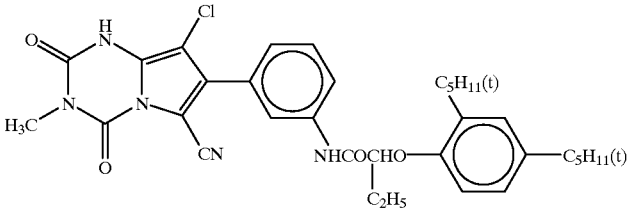
C-150
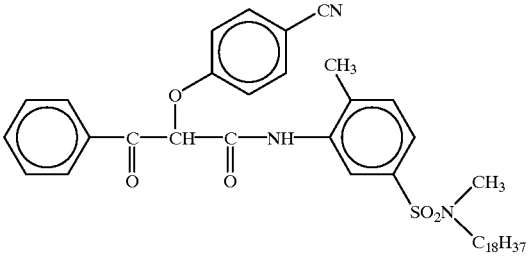

-continued
C-151
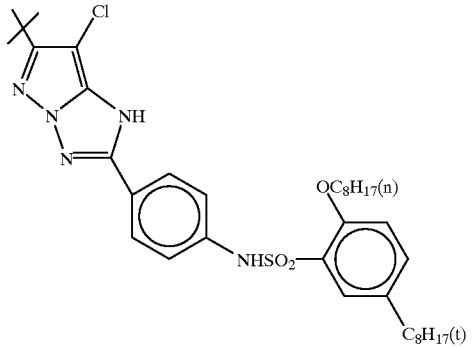
C-152
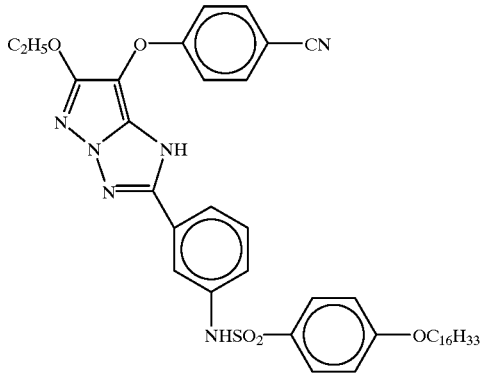
C-153
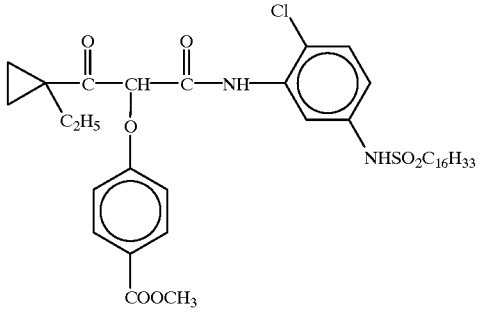
C-154
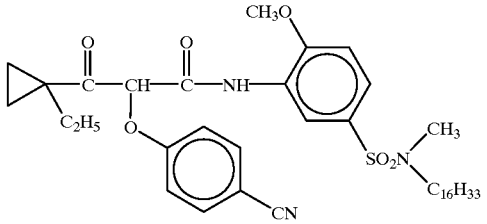

-continued
C-155
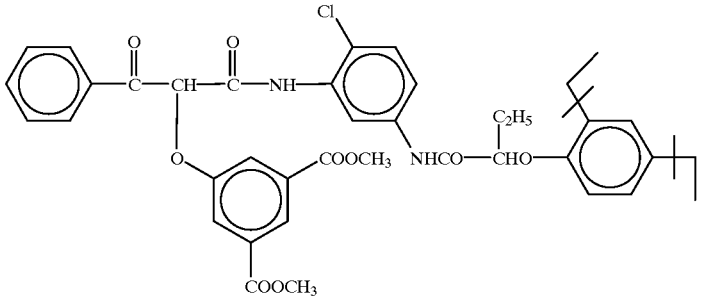
C-156
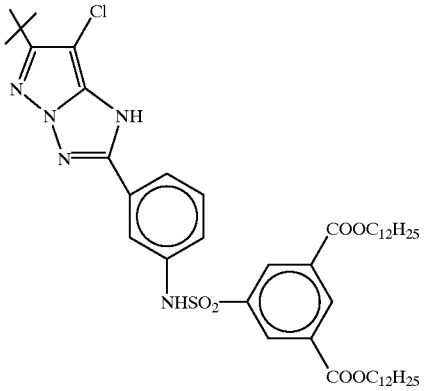
C-157
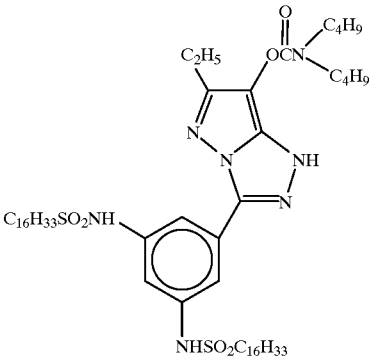
C-158
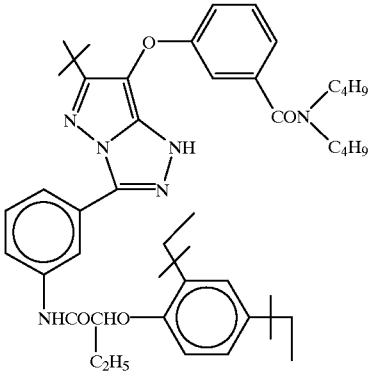

-continued
C-159
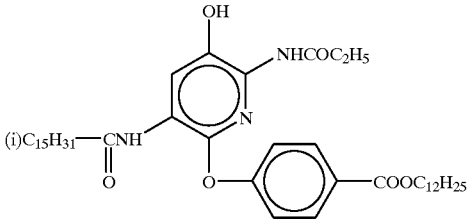
C-160
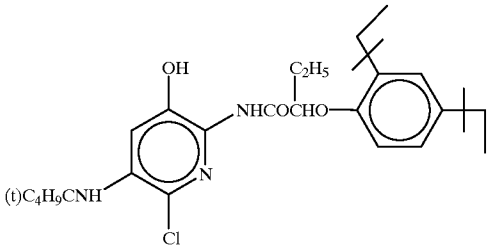
C-161
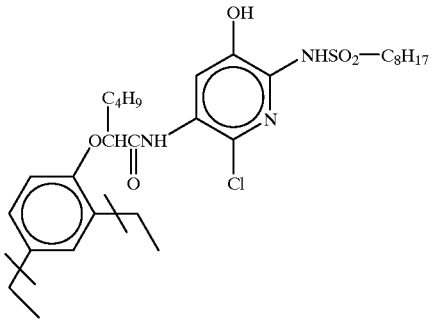
C-162
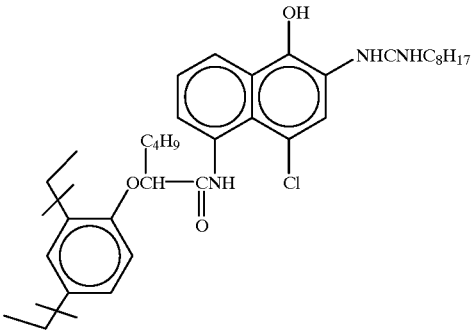
C-163
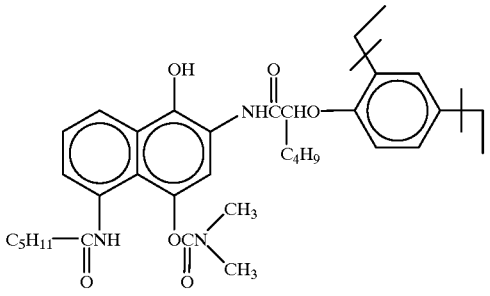

-continued
C-164
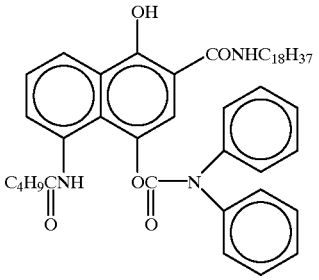
C-165
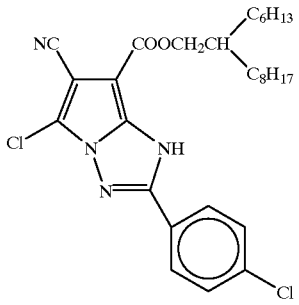
C-166
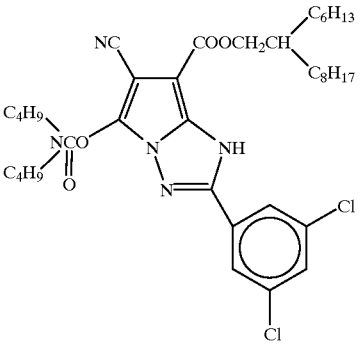
C-167
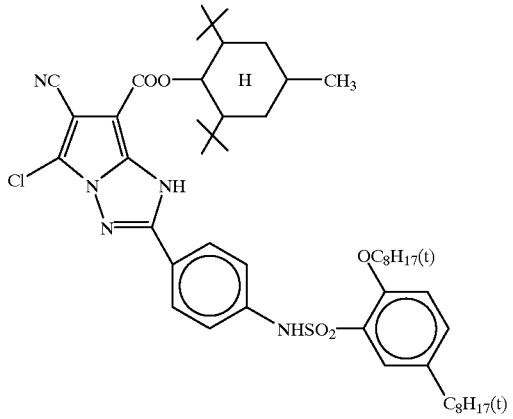

-continued
C-168
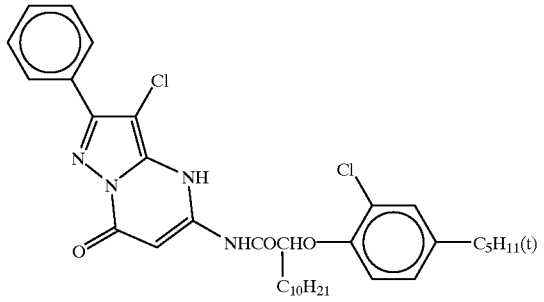
C-169
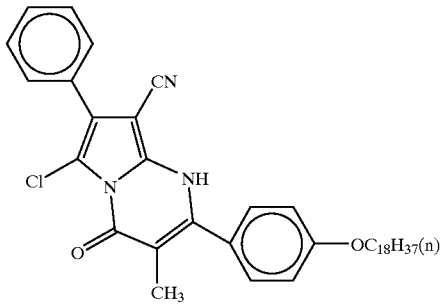
C-170
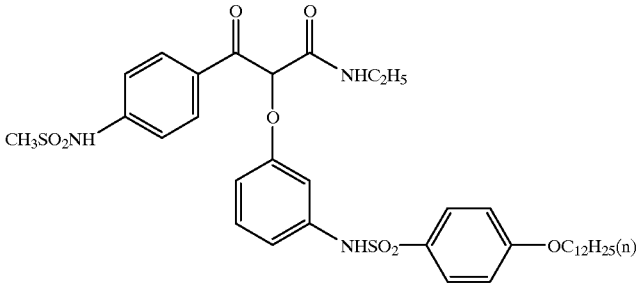
C-171
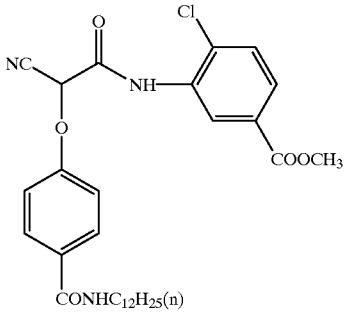
C-172
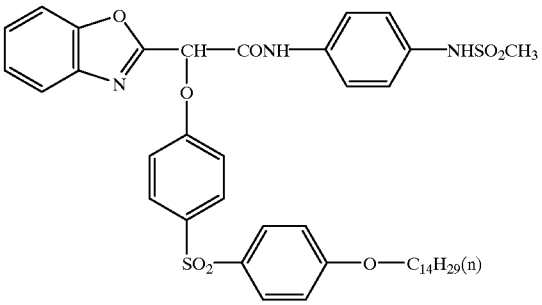

-continued
C-173
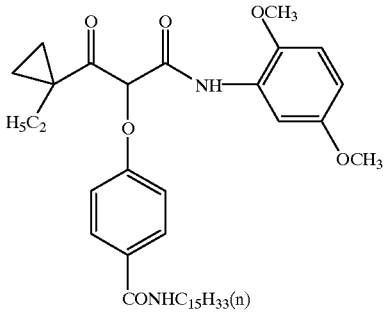
C-174
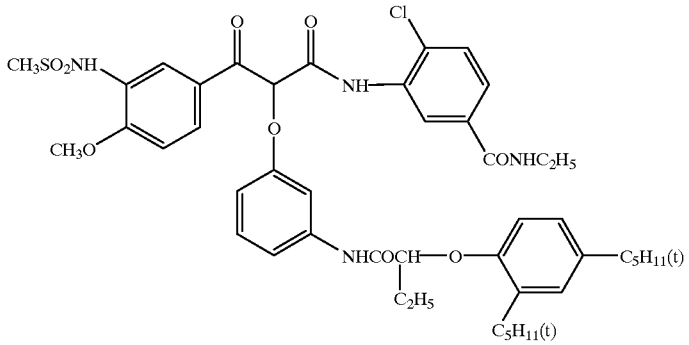
C-175
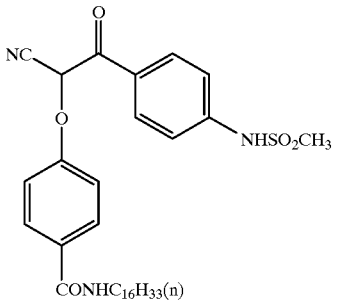
C-176
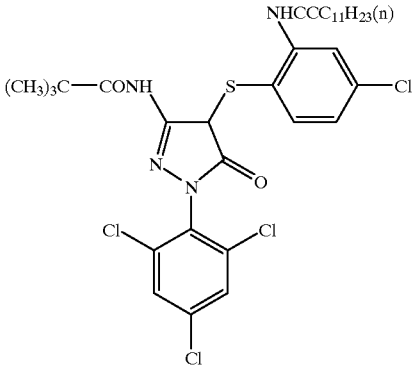

-continued
C-177
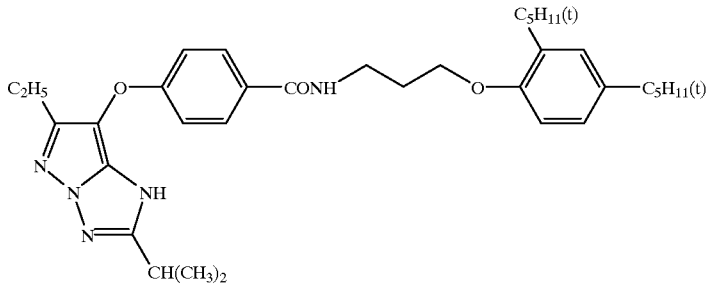
C-178
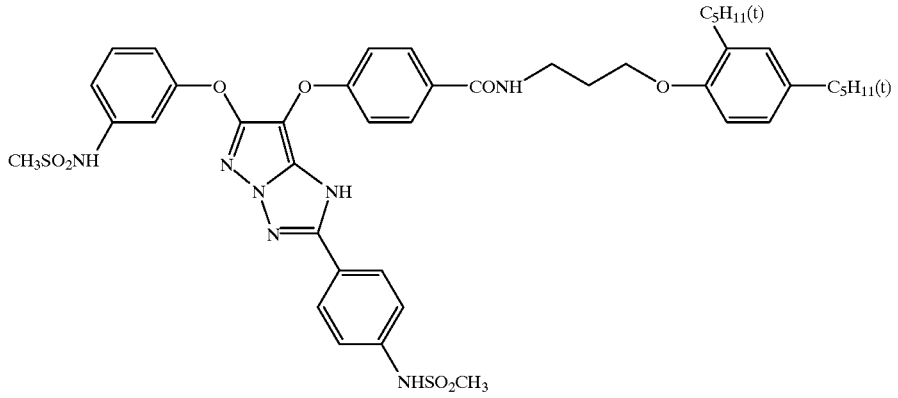
C-179
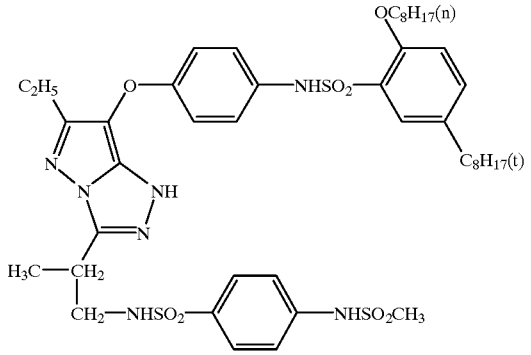
C-180
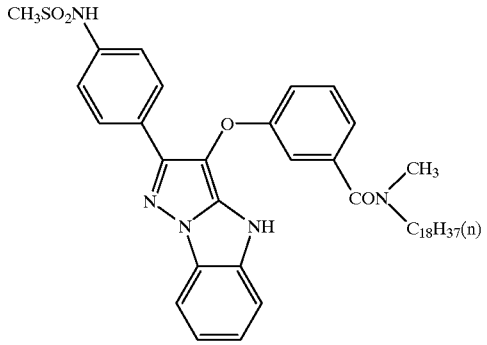

-continued
C-181
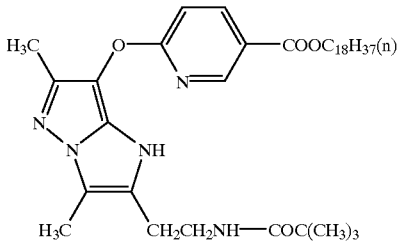
C-182
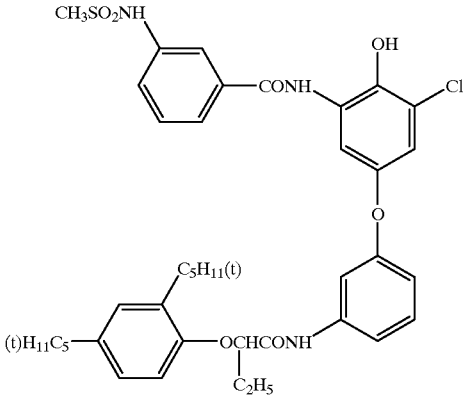
C-183
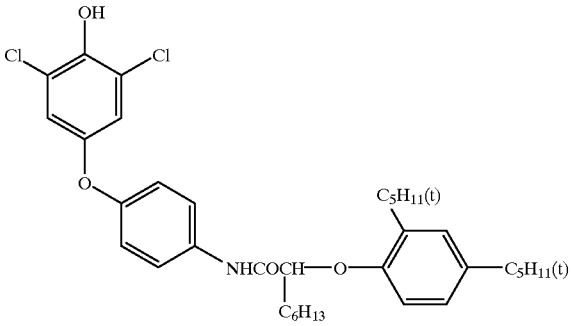
C-184
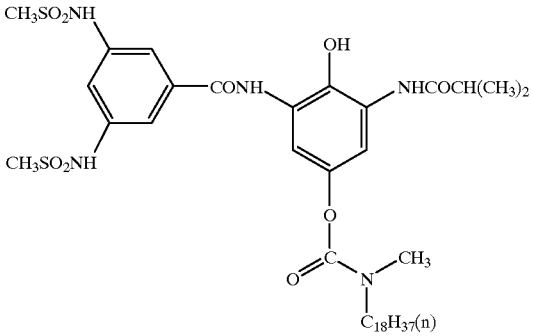

-continued
C-185
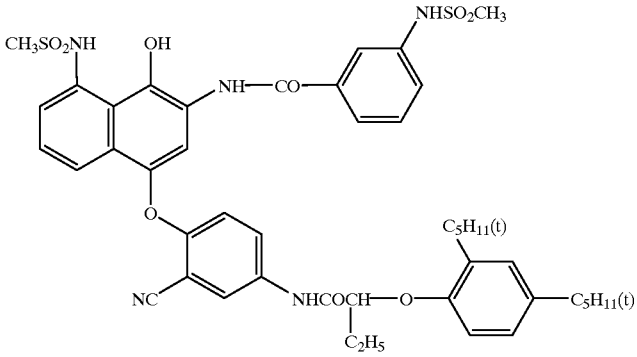
C-186
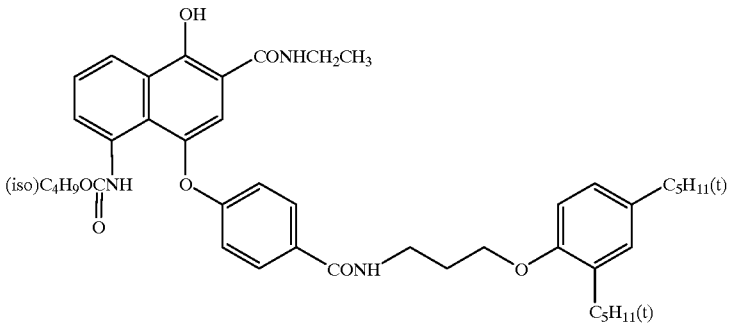
C-187
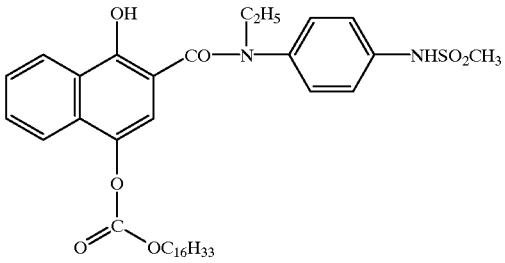
C-188
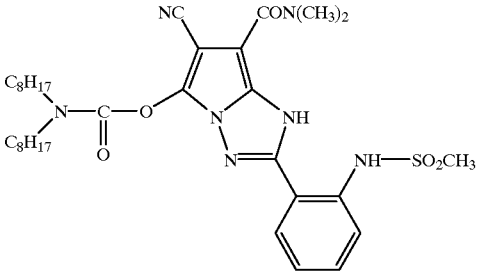

-continued
C-189
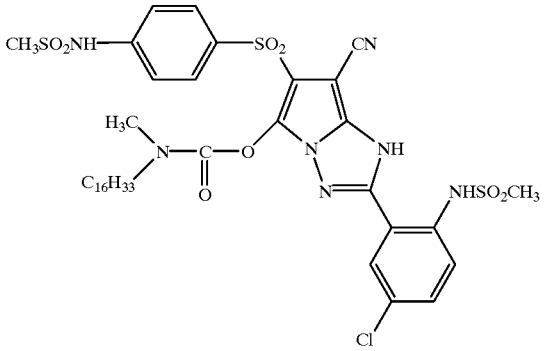
C-190
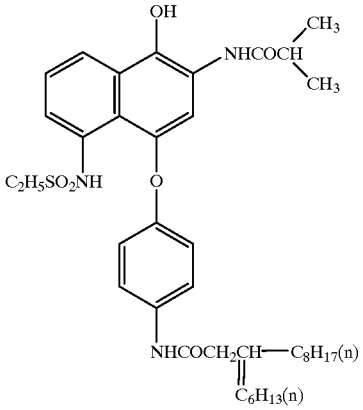
C-191
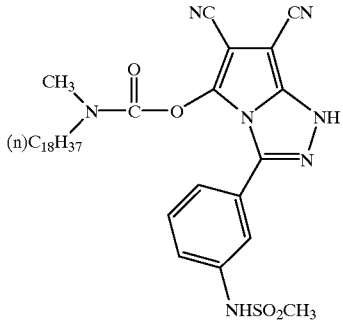
C-192
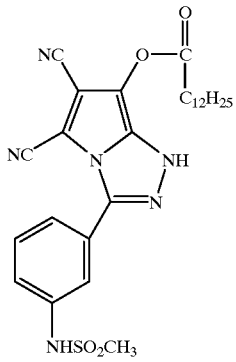

-continued
C-193
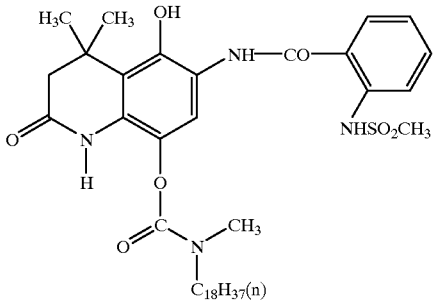
C-194
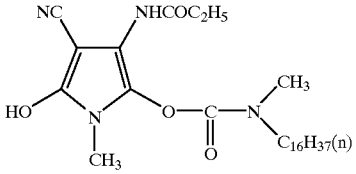
C-195
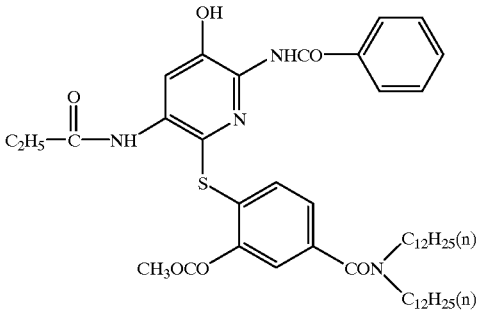
C-196
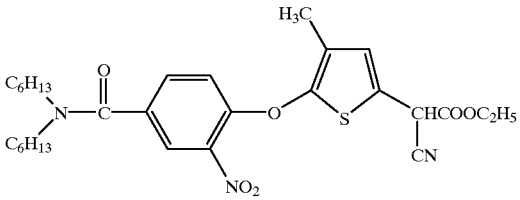
C-197
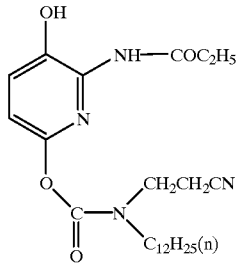

-continued

C-198

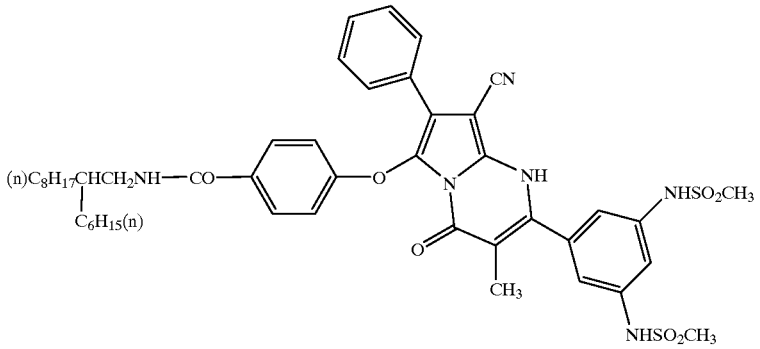

C-199

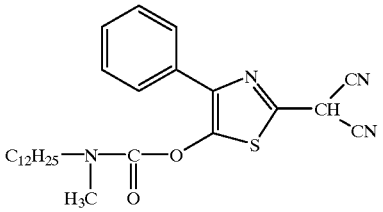

The amount added of the above-described coupler depends on molar absorptivity (E) thereof, and in the case of a coupler in which $\epsilon$ of a dye produced by coupling is from about 5,000 to 500,000, it is suitable that the amount coated is from about 0.001 to 100 mmol/$m^2$, preferably from about 0.01 to 10 mmol/$m^2$, and more preferably from about 0.05 to 5 mmol/$m^2$, in order to obtain an image concentration of 1.0 or more in terms of reflection concentration.

The silver halide photographic light-sensible material of the present invention basically comprises a support having thereon light-sensitive silver halide, coupler as a dye donative compound, reducing agent and binder, and optionally can contain an organic metal salt oxidizing agent and the like.

These components are often added to the same layer, and also can be divided and added to different layers provided they are in condition that they can react each other.

To obtain wide range of colors on a chromaticity chart using three primary colors of yellow, magenta and cyan, at least three silver halide emulsion layers each having light-sensitivity in different spectral range are combined for use. Examples thereof may include a three layer structure combining a blue sensitive layer, a green sensitive layer and a red sensitive layer, a three layer structure combining a green sensitive layer, a red sensitive layer and an infrared sensitive layer, and the like. Each light-sensitive layer can adopt various arranging orders known in usual color light-sensitive materials. These light-sensitive layers may each be optionally separated into two or more layers.

On the silver halide photographic light-sensitive material, there can optionally be formed various complementary layers such as a protective layer, primer layer, intermediate layer, antihalation layer, back layer and the like. Further, various filter dyes can also be added to improve color separation property.

The silver halide emulsion which can be used in the silver halide photographic light-sensitive material of the present invention is not particularly limited to, and may be any of silver chloride, silver bromide, silver iodine bromide, silver chloride bromide, silver chloride iodide and silver chloride iodide bromide.

The silver halide emulsion used in the present invention may be surface latent image-type emulsion or also inner latent image-type emulsion. The inner latent image-type emulsion is combined with a nuclear forming agent and light fogging agent and used as a direct inversion emulsion. Also, a so-called core-shell emulsion in which inner part has different phase from that of surface part of a particle may be possible, and silver halide having different composition may be connected by epitaxial connection. The silver halide emulsion may be mono dispersion or also multi dispersion type, and there is preferably used a method in which mono dispersion emulsions are mixed and gradation is controlled as described in JP-A Nos. 1-167,743 and 4-223,463. The particle size is from 0.1 to 2 $\mu$m, and 0.2 to 1.5 $\mu$m is particularly preferable. The crystal habit of the silver halide particle may be any of one comprising a regular crystal such as cube, octahedron and tetradecahedron, one comprising irregular crystal system such as sphere, plane having high aspect ratio, one comprising crystal defect such as twin crystal surface, and complex system thereof.

Specifically, there can be used any silver halide emulsion prepared by using a method described in U.S. Pat. No. 4,500,626, column 50, U.S. Pat. No. 4,628,021, Research Disclosure (hereinafter abbreviated as RD) No. 17,029 (1978), RD No. 17,643 (December 1978), pp. 22–23, RD No. 18,716 (November 1979), pp. 648, RD No. 307,105 (November 1988), pp. 863–865, JP-A Nos. 62-253,159, 64-13,546, 2-236,546 and 3-110,555, P. Glafkides, Chimie et Physique Photographique, Paul montel, 1967, G. F. Duffin, Photographic Emulsion Chemistry, Focal Press, 1966, and V. L. Zelikman et al., Making and Coating Photographic Emulsion, Focal Press, 1964, and the like.

In the process for preparing the light-sensitive silver halide emulsion of the present invention, it is preferable that a salt removing process be conducted in order to remove excessive salt. For the removal of salt, employable methods includes a Noodle water-washing method in which gelatin is subjected to gelation and a flocculation method which utilizes an inorganic salt comprising a polyvalent anion (e.g., sodium sulfate), an anionic surfactant, an anionic polymer (e.g., polystyrene sulfonic acid sodium salt) or a gelatin derivative (e.g., aliphatic-acylated gelation, aromatic-acylated gelatin and aromatic-carbamoylated gelatin). A flocculation method is preferably used.

For a variety of purposes, the light-sensitive silver halide emulsion in the present invention may contain a heavy metal such as iridium, rhodium, platinum, cadmium, zinc, thallium, lead, iron and osmium. These heavy metals may be used alone or in a combination of two or more of them. Although the amount added of such compounds varies depending on the purpose of use and can not be defined unconditionally, this amount is generally in the range of $10^{-9}$ to $10^{-3}$ mol based on 1 mol of silver halide. The heavy metal may be present uniformly in silver halide grains or may be present in a localized manner within or on the surface of silver halide grains. Preferred examples of these emulsions are the emulsions described in JP-A Nos. 2-236,542, 1-116, 637 and 5-181,246.

Such compound as a rhodanate, ammonia, a tetra-substituted thioether compound, an organic thioether derivative described in Japanese Patent Application Publication (JP-B) No. 47-11,386 and a sulfur-containing compound described in JP-A No. 53-144,319 may be used as a solvent for silver halide in the grain forming stage for the light-sensitive silver halide emulsion used in the present invention.

For other conditions for the silver halide grain formation, reference will be made, for example, to P. Glafkides, Chimie et Phisique Photographique, Paul Montel, 1967, G. F. Duffin, Photographic Emulsion Chemistry, Focal Press, 1966, V. L. Zelikman et al., Making and Coating Photographic Emulsion, Focal Press, 1964, and the like. That is, an employable method may be selected from an acidic method, a neutral method and an ammonia method. Further, any method selected from a single jet method, a double jet method and a combination thereof may be used as a method for reacting a soluble silver salt with a soluble halide. A double jet method is preferable for obtaining a monodisperse emulsion.

An reversed mixing method in which grains are formed in the presence of an excess of silver iron can also be employed. A so-called controlled double jet method in which pAg of the liquid phase for the formation of silver halide is kept constant can also be employed as a double jet method.

Meanwhile, the concentrations, amounts to be added and adding rates of the silver salt and halogen salt may be increased in order to accelerate the growth of the grains (JP-A Nos. 55-142,329 and 55-158,124 and U.S. Pat. No. 3,650,757).

The stirring of the reaction mixture may be effected by any known method. Further, the temperature and pH of the reaction mixture during the formation of silver halide grains may be selected depending on the purpose. The pH is preferably in the range of 2.2 to 8.5, and more preferably 2.5 to 7.5.

A light-sensitive silver halide emulsion is normally a chemically sensitized silver halide emulsion. A sensitizing method by means of chalcogen, such as sulfur sensitization, selenium sensitization or tellurium sensitization, a sensitizing method by means of a rare metal, such as gold, platinum or palladium, and a sensitizing method by means of reduction, which are known sensitizing methods in the preparation of conventional light-sensitive emulsions, may be used alone or in combination thereof as a chemical sensitizing method of the light-sensitive silver halide emulsion used in the present invention (see, for example, JP-A Nos. 3-110,555 and 5-241,267) . A chemical sensitization according any of the above-mentioned methods can be effected in the presence of a nitrogen-containing heterocyclic compound (JP-A No. 62-253,159). Beside, an anti-fogging agent, which is described later, may be added to a silver halide emulsion after the chemical sensitization thereof. More concretely, the method, which are described in JP-A Nos. 5-45,833 and 62-40,446, can be used.

When a chemical sensitization is carried out, pH is preferably in the range of 5.3 to 10.5, and more preferably 5.5 to 8.5, while pAg is preferably in the range of 6.0 to 10.5, and more preferably 6.8 to 9.0.

The coated weight of the light-sensitive silver halide to be used in the present invention is in the range of 1 $mg/m^2$ to 10 $g/m^2$ based on the weight of silver.

In order to impart color-sensitivity, such as green-sensitivity, red-sensitivity or infrared-sensitivity, to the light-sensitive silver halide as used in the present invention, the light sensitive silver halide emulsion is spectrally sensitized by means of a methine dye or the like. Further, if necessary, a blue-sensitive emulsion may be spectrally sensitized in order to enhance sensitivity to the light of the blue color region.

Examples of employable dyes include cyanine dyes, merocyvanine dyes, complex cyanine dyes, complex merocyanine dyes, holopolar cyanine dyes, hemicyanine dyes, styryl dyes and hemioxonol dyes, and the like.

More concrete examples of these sensitizing dyes are disclosed, for example, in U.S. Pat. No. 4, 617, 257 and JP-A Nos. 59-180,550, 64-13,546, 5-45,828 and 5-45,834.

Although these sensitizing dyes may be used alone, they may also be used in a combination thereof. A combination of these sensitizing dyes in often used particularly for supersensitization or for wavelength adjustment of spectral sensitization.

The light-sensitive silver halide emulsion used in the present invention may contain a compound which is a dye having no spectral sensitization effect itself or a compound substantially incapable of absorbing a visible light but which exhibits a supersensitizing effect together with the sensitizing dyes (e. g., compounds described in U.S. Pat. No. 3,615,641 and JP-A No. 63-23,145).

The above-mentioned sensitizing dye can be added to the emulsion at the stage of chemical aging or thereabout, or before or after the formation of the nucleus of the silver halide grains in accordance with the descriptions in U.S. Pat. Nos. 4,183,756 and 4,225,666. These sensitizing dyes or supersensitizers may be added to the emulsion as a solution in an organic solvent, such as methanol, and dispersion in gelation or solution containing a surfactant. The amount to be added is generally in the range of $10^{-8}$ to $10^{-2}$ mol based on 1 mol of silver halide.

Known photographic additives, which are used in the above-described processes and in the present invention, are described in the aforementioned RD NO. 17,643, RD No. 18,715 and RD No. 307,105, the relationship in the description is shown below.

| Kinds of additives: | RD 17,643 | RD 18,716 RD 307,105 |
|---|---|---|
| 1. Chemical sensitizer | pp. 23 | pp. 648, RC pp. 866 |
| 2. Sensitivity enhancer | | pp. 648, RC |
| 3. Spectral sensitizer/ Supersensitizer | pp. 23–24 | pp. 648, RC pp. 866~868 ~pp. 649, RC |
| 4. Brightening agent | pp. 24 | pp. 648, RC pp. 868 |

-continued

| | | |
|---|---|---|
| 5. Anti-fogging agent/ Stabilizer | pp.24–25 | pp. 649, RC pp. 868–870 |
| 6. Light absorber/ Filter dye/ Ultraviolet ray absorber | pp. 25–26 | pp. 649, RC pp.873 ~pp. 650, LC |
| 7. Dye image stabilizer | pp. 25 | pp. 650, LC pp. 872 |
| 8. Film hardener | pp. 26 | pp. 651, LC pp. 874–875 |
| 9. Binder | pp. 26 | pp. 651, LC pp. 873–874 |
| 10. Plasticizer/ Lubricant | pp. 27 | pp. 650, RC pp. 876 |
| 11. Coating aid/ Surfactant | pp. 26–27 | pp. 650, RC pp. 875–876 |
| 12. Anti-static agent | pp. 27 | pp. 650, RC pp. 876–877 |
| 13 Matting agent | | pp. 878–879 |

(RC: right column, LC: left column)

The binder for a constituent layer of the silver halide photographic light-sensitive material is preferably a hydrophilic material. Examples thereof may include those described in the aforesaid Research Disclosure and in JP-A No. 64-13,546, pp. 71–75. More specifically, the binder is preferably a transparent or translucent hydrophilic material, exemplified by a naturally occurring compound, such as a protein including gelatin and a gelatin derivative; and a polysaccharide including a cellulose derivative, starch, gum arabic, dextran and pullulane, and by a synthetic polymer such as polyvinyl alcohol, polyvinyl pyrrolidone and acryl amide polymer. Also usable as the binder is a highly water-absorbent polymer described in U.S. Pat. No. 4,960,681 and JP-A No. 62-245,260, for example, a homopolymer composed of a vinyl monomer having —COOM or —$SO_3M$ (M stands for a hydrogen atom or an alkali metal), or a copolymer obtained by a combination of these monomers or obtained by a combination of at least one of these monomers and another monomer(s) such as sodium methacrylate and ammonium methacrylate (e.g., SUMIKAGEL L-H5 manufactured by Sumitomo Chemical Co., Ltd.) . These binders may be used alone or in a combination of two or more of them. Particularly, a combination of gelatin and any of the above-mentioned non-gelatin binders is preferable. Depending on purposes, a lime-processed gelatin, acid-processed gelatin and delimed gelatin which has undergone a deliming process to decrease the content of calcium and the like can be used. Though these gelatin substances may be used alone, a combination of these treated gelatin substances may also be preferably employed.

An organic metal salt may be used as an oxidant together with a light-sensitive silver halide in the present invention. Among these organic metal salts, an organic silver salt is particularly preferable.

Examples of the organic compounds which can be used for the preparation of the above-mentioned organic silver salts serving as an oxidant may include benzotriazoles, fatty acids and other compounds described in U.S. Pat. No. 4,500,626, columns 52–53. The silver acetylide, which is described in U.S. Pat. No. 4,775,613, is also useful. These organic silver salts may also be used in a combination of two or more of them.

The above-mentioned organic silver salt can be used in an amount in the range of 0.01 to 10 mol, and preferably 0.01 to 1 mol, based on 1 mol of the light-sensitive silver halide. The total coated weight of the light-sensitive silver halide and the organic silver salt is in the range of 0.05 to 10 g/$m^2$, and preferably 0.1 to 4 g/$m^2$, based on the weight of silver.

In the silver halide photographic light-sensitive material of the present invention, there can be used a compound useful for activation of developing and stabilization of an image simultaneously. Specific examples of compounds preferably used are described in U.S. Pat. No. 4,500,626, columns 51 to 52. Further, there can be also used a compound which can fix a silver halide as described in JP-A No. 8-69,097.

Examples of the film hardener used in the constitutional layer of the silver halide photographic light-sensitive material may include those described in the above-described Research Disclosures, U.S. Pat. Nos. 4,678,739, column 41 and 4,791,042, and in JP-A Nos. 59-116,655, 62-245,261, 61-18,942 and 42-18,044. More specifically, examples of these hardeners may include an aldehyde (e.g., formaldehyde), an aziridine, an epoxy, a vinylsulfone (e.g., N,N'-ethylenebis(vinylsulfonylacetamide)ethane), a N-methylol compound (e.g., dimethylolurea) and a polymeric compound (e.g., a compound descried in JP-A No. 62-234,157).

The amount of the hardener added may be in the range of 0.001 to 1 g, and preferably 0.005 to 0.5 g, based on 1 g of coated gelatin. Further, a layer to which the film hardener is added may be any layer of constitutional layers of a light-sensitive material and dye fixing material, and also may be separated into two or more layers before addition of the hardener.

The constitutional layers of the silver halide photographic light-sensitive material may contain various anti-fogging agents or photographic stabilizers as well as precursors thereof. Examples thereof may include the compounds described in the aforesaid Research Disclosure, U.S. Pat. Nos. 5,089,378, 4,500,627 and 4,614,702, JP-A No. 64-13,546, pp.7–9, pp. 57–71 and pp. 81–97, U.S. Pat. Nos. 4,775,610, 4,626,500 and 4,983,494, JP-A Nos. 62-174,747, 62-239,148, 63-264,747, 1-150,135, 2-110,557, 2-178,650 and RD 17,643 (1978) pp. 24–25.

The amount of these compounds added may be preferably in the range of $5\times10^{-6}$ to $1\times10^{-1}$ mol, and more preferably $1\times10^{-5}$ to $1\times10^{-2}$ mol, based on 1 mol of silver.

For such purposes as improvement of the coatability, improvement of the releasability, improvement of the slipperiness, prevention of electrostatic charge and acceleration of developing reaction, a surfactant may be added to the constitutional layers of the silver halide photographic light-sensitive material. Examples of the surfactants may include those described in the above-described Research Disclosure, JP-A Nos. 62-173,463 and 62-183,457.

For such purposes as prevention of slip, prevention of electrostatic charge and improvement of the releasability, an organic fluorine-containing compound may be added to the constitutional layers of the silver halide photographic light-sensitive. Typical examples of the organic fluorine-containing compounds include a fluorine-containing surfactant and a hydrophobic fluorine-containing compound, such as an oily fluorine-containing compound, e.g., fluorocarbon oil, and a solid fluorine-containing resin, e.g., tetrafluoroethylene, described in JP-B No. 57-9,053, column 8-17, JP-A Nos. 51-20,944 and 62-135,825.

For such purposes as prevention of adhesion, improvement of slipperiness, formation of non-gloss surface and the like, a matting agents can be used in the silver halide photographic light-sensitive material.

Examples of the matting agent may include compounds described in JP-A Nos. 63-274,944 and 63-274,952 such as a benzoguanamine resin bead, polycarbonate resin bead, AS resin bead and the like, in addition to compounds described in JP-A No. 61-88,256, pp. 29 such as silicon dioxide, polyolefin, polymethacrylate and the like.

Further, compounds described in the above-described Research Disclosure can be used. These matting agents can be added, if necessary, not only to the top layer (protective layer) but also to a lower layer.

Further, the constitutional layers of the silver halide photographic light-sensitive material may contain heat solvent, de-foaming agent, antimicrobial agent, colloidal silica and the like. Specific examples of these additives are described in JP-A No. 61-88,256, pp. 26 to 32, JP-A No. 3-11,338, JP-B No. 2-51,496 and the like.

In the silver halide photographic light-sensitive material of the present invention, an image formation accelerator can be used. The image formation accelerator has such functions as promotion of a redox reaction of a silver salt oxidizing agent with a reducing agent, promotion of a dye formation reaction, and the like, and is classified from the view point of physicochemical functions into a base or base precursor, nucleophilic compound, high boiling point organic solvent (oil), heat solvent, surfactant, compound having mutual action with silver or silver ion, and the like. Since these compounds have generally complex functions, they usually have several functions described above in combination. The details thereof are described in U.S. Pat. No. 4,678,739, pp. 38 to 40.

In the silver halide photographic light-sensitive material of the present invention, various development stopping agents can be used to obtain constant images in spite of variations in treating temperature and treating time in developing.

The development stopping agent means a compound which, after suitable developing, neutralizes a base or reacts with a base quickly to lower the base concentration in a film to stop the development, or a compound which acts on silver or silver salt mutually to suppress the development. Specific examples thereof may include an acid precursor which releases an acid by heating, an electrophilic compound which causes substitution reaction with a coexisting base by heating, a nitrogen-containing heterocyclic compound, a mercapto compound and precursors thereof, and the like. Further details are described in JP-A No. 62-253159, pp. 31 to 32.

For exposure and recording of an image on a silver halide photographic light-sensitive material, there are, for example, methods in which scenery and people are directly photographed using a camera, methods in which exposure is effected through a reversal film or negative film using a printer and projector, methods in which scanning exposure of an original image is effected through a slit and the like using an exposing apparatus of a copy machine, methods in which light emission is effected from an emission diode, various lasers (laser diode, gas laser) and the like via electric signals and scanning exposure is conducted on an image information (methods described in JP-A Nos. 2-129625, 5-176144, 5-199372, 6-127021 and the like), methods in which image information is output on image showing apparatus such as CRT, liquid crystal display, electroluminescence display, plasma display and the like, and exposure is effected directly or with an optical system, and the like.

As the light source for recording an image on a silver halide photographic light-sensitive material, there can be used light sources and exposing methods described in U.S. Pat. No. 4,500,626, column 56, JP-A Nos. 2-53,378 and 2-54,672 such as natural light, tungsten lamp, light emitting diode, laser light source, CRT light source and the like, as described above.

Further, image exposure can also be conducted using a wavelength converting element which is obtained by combining a non-linear optical material with a coherent light source such as laser light and the like.

The non-linear optical material is a material which can manifest non-linear characteristic between electric field and polarization which occurs when strong light electric field such as laser light is imparted, and there are preferably used inorganic compounds represented by lithium niobate, potassium dihydrogen phosphate (KDP), lithium iodate, $BaB_2O_4$ and the like, urea derivatives, nitroaniline derivatives, for example, nitropyridine-N-oxide derivatives such as 3-methyl-4-nitropyridine-N-oxide (POM), compounds described in JP-A Nos. 61-53462 and 62-210432. As the form of the wavelength converting element, monocrystalline light directing route type, fiber type and the like are known, and all of them are effective.

Further, the above-described image information can utilize image signals obtained from a video camera, electronic still camera and the like, television signals represented by that stipulated by Nippon Television Signal Criteria (NTSC), image signals obtained by dividing an original image into many picture elements such as a scanner, and image signals made by a computer represented by CG, CAD.

The silver halide photographic light-sensitive material of the present invention may adopt form having an electroconductive heat generating layer as a heating means for heat phenomenon. As the heat generating element in this case, those described in JP-A No. 61-145544 and the like can be used.

The heating temperature in the process for the above-described heat phenomenon is from about 80 to 180° C., and the heating time is from 0.1 to 60 seconds.

Examples of the heating method in the developing process include such methods as contact with a heated block and plate, contact with a heat plate, hot presser, heat roller, heat drum, halogen lamp heater, infrared and far infrared lamp heater and the like, passing through a high temperature atmosphere, and the like.

As the method for laminating a dye fixing material on a silver halide photographic light-sensitive material, for example, methods described in JP-A Nos. 62-253,159 and 61-147244, pp. 27 are applicable.

EXAMPLES

The following examples further illustrate the present invention in detail, but do not limit the scope thereof.

(Example 1)

<Preparation of light-sensitive silver halide emulsion-1>

To a well stirred gelatin solution (30 g of inactive gelatin and 2 g of potassium bromide in 1000 ml of water) was added ammonia-ammonium nitrate as a solvent and the temperature was kept at 75° C. To this were added 1000 ml of an aqueous solution containing 1 mol of silver nitrate and 1000 ml of an aqueous solution containing 1 mol of potassium bromide and 0.03 mol of potassium iodide over a period of 78 minutes simultaneously. After washing with water and desalting, inactive gelatin was added for re-dispersion, and a silver iodine bromide emulsion containing iodine at a level of 3mol % and having a spherical grain diameter of 0.76 $\mu$m was prepared. The spherical grain diameter was measured by Model TA-3 manufactured by Coalter Counter Corp.

To the emulsion were added potassium thiocyanate, chloroauric acid and sodium tihosulfate at 56° C., and optimum chemical sensitization was effected. A sensitizing dye was added to this emulsion in preparing the coating solution to impart color sensitivity.

<Preparation of zinc hydroxide dispersion>

31 grams of a powder of zinc hydroxide having a particle size of a primary particle of 0.2 $\mu$m, 1.6 g of carboxymethylcellulose and 0.4 g of poly sodium acrylate as a dispersing agent, 8.5 g of lime-treated osein gelatin and 158.5 ml of water were mixed, and this mixture was dispersed for 1 hour by a mill using glass beads. After dispersion, the glass beads were separated by filtration, to obtain 188 g of a zinc hydroxide dispersion.

<Preparation of emulsion dispersion of coupler>

Oil phase components and aqueous phase components having compositions shown in Table 1 were respectively dissolved to prepare uniform solutions of 60° C. The oil phase components and the aqueous phase components were combined, and this mixture was stirred at 10000 rpm for 20 minutes by a dissolver equipped with a disperser having a diameter of 5 cm in a 1L stainless vessel. To this was added hot water in amount shown in Table 1 as post addition water, and they were mixed at 2000 rpm for 10 minutes. Thus, an emulsified dispersion of a coupler was prepared.

TABLE 1

| | | Emulsion |
|---|---|---|
| Oil phase | Magenta dye forming coupler (1) | 6.36 g |
| | Developing agent (2) | 5.46 g |
| | Organic solvent having a high boiling point (3) | 5.91 g |
| | Ethyl acetate | 24.0 ml |
| Water phase | Lime-processed gelatin | 12.0 g |
| | Surfactant (4) | 0.60 g |
| | Water | 138.0 ml |
| | Later added water | 180.0 ml |

Magenta dye forming coupler (1)

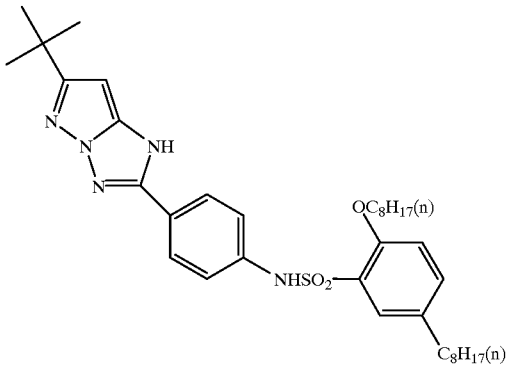

Developing agent (2)

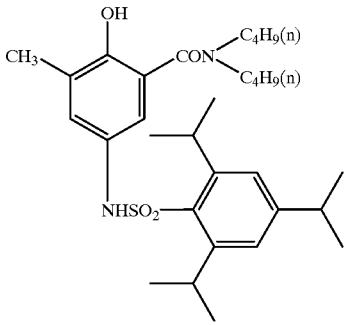

Organic solvent having a high boiling point (3)

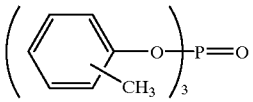

Surfactant (4)

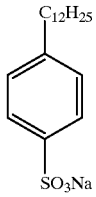

A silver halide photographic light-sensitive material 101 (comparative example) was made having multilayer structure shown in Table 2 using the material obtained as described above.

TABLE 2

Structure of light-sensitive material 101

| Constituent layer | Added substance | Amount added ($mg/m^2$) |
|---|---|---|
| 3rd layer | Lime-processed gelatin | 1000 |
| Protective layer | Matting agent (silica) | 50 |
| | Surfactant (5) | 100 |
| | Surfactant (6) | 300 |
| | Water-soluble polymer (7) | 15 |
| | Hardener (8) | 40 |
| 2nd layer | Lime-processed gelatin | 1000 |
| Intermediate layer | Surfactant (6) | 15 |
| | Zinc hydroxide | 1130 |
| | Water-soluble polymer (7) | 15 |
| 1st layer | Light-sensitive silver | based on silver 1728 |
| Color developing | halide emulsion-1 | |
| layer | Lime-processed gelatin | 1600 |
| | Sensitizing dye (9) | 0.18 |
| | Sensitizing dye (10) | 1.80 |
| | Sensitizing dye (11) | 0.49 |
| | Anti-fogging agent (12) | 6 |
| | Coupler (1) | 636 |
| | Developing agent (2) | 546 |
| | Organic solvent having a high boiling point (3) | 591 |
| | Surfactant (4) | 60 |
| | Water-soluble polymer (7) | 20 |
| | Transparent PET base (102 $\mu$m) | |

Surfactant (5)

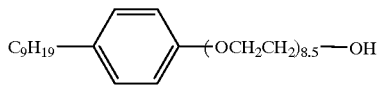

Surfactant (6)

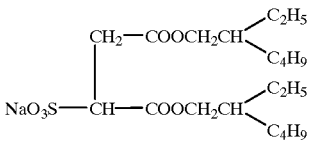

Water-soluble polymer (7)

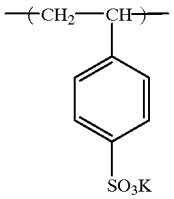

Hardener (8)

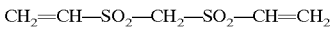

Sensitizing dye (9)

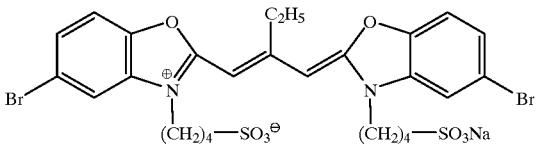

Sensitizing dye (10)

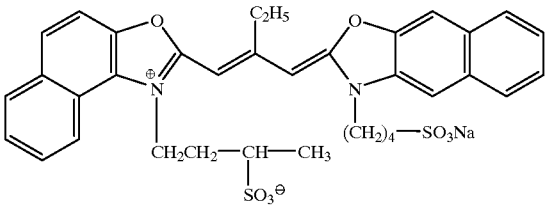

Sensitizing dye (11)

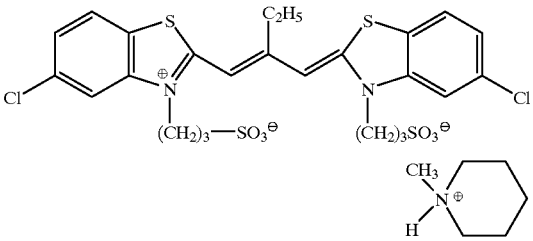

Anti-fogging agent (12)

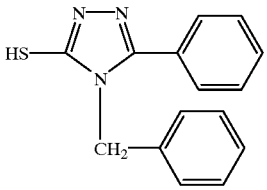

Then, treating sheets R-1 of which constitutions are shown in Tables 3, 4 and 5 were made. Table 4 is continuation of Table 3.

TABLE 3

Constitution of treating material R-1

| Constituent layer | Added substance | Amount added ($mg/m^2$) |
|---|---|---|
| 4th layer | Acid-processed gelatin | 220 |
| Protective layer | Water-soluble polymer (13) | 60 |
| | Water-soluble polymer (14) | 200 |
| | Additive (15) | 80 |
| | Palladium sulfide | 3 |
| | Potassium nitrate | 12 |
| | Matting agent (16) | 10 |
| | Surfactant (6) | 7 |
| | Surfactant (17) | 7 |
| | Surfactant (18) | 10 |
| 3rd layer | Lime-processed gelatin | 240 |
| Intermediate layer | Water-soluble polymer (14) | 24 |
| | Hardener (19) | 180 |
| | Surfactant (4) | 9 |
| 2nd layer | Lime-processed gelatin | 2400 |
| Base generating layer | Water-soluble polymer (14) | 360 |
| | Water-soluble polymer (20) | 700 |
| | Water-soluble polymer (21) | 600 |
| | Organic solvent having a high boiling point (22) | 2000 |
| | Additive (23) | 20 |
| | Hydantoin potassium | 260 |
| | Guanidine picolinate | 2910 |
| | Potassium quinolinate | 225 |
| | Sodium quinolinate | 180 |
| | Surfactant (4) | 24 |

TABLE 4

| | | |
|---|---|---|
| 1st layer | Lime-processed gelatin | 280 |
| Undercoat layer | Water-soluble polymer (12) | 12 |
| | Surfactant (6) | 14 |
| | Hardener (19) | 185 |
| | Transparent support A (63 $\mu$m) | |

TABLE 5

Constitution of support A

| Name of layer | Composition | Weight ($mg/m^2$) |
|---|---|---|
| Undercoat layer on the front side | Lime-processed gelatin | 100 |
| Polymer layer | Polyethylene terephthalate | 62500 |
| Undercoat layer on the reverse side | Polymer (methyl methacylate-styrene-2-ethylhexyl acrylate-methacrylic acid copolymer) | 1000 |
| | PMMA latex | 120 |

Water-soluble polymer (13) K-carageenan Water-soluble polymer (14) SUMIKAGEL L-5H (manufactured by Sumitomo Chemical Co., Ltd.)

Additive (15)

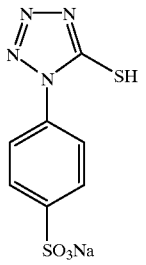

Matting agent (16) SYLOID79 (manufactured by Fuji Devison Corp.)

Surfactant (17)

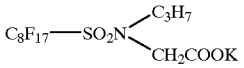

Surfactant (18)

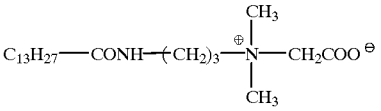

Film hardener (19)

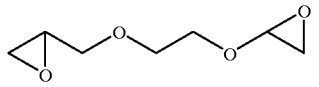

Water-soluble polymer (20) dextran (molecular weight: 70000) Water-soluble polymer (21) MP polymer MP 102 (manufactured by Kuraray Co., Ltd.) Organic solvent having high boiling point (22): En-Para 40 (manufactured by Ajinomoto Co., Inc.) Additive (23)

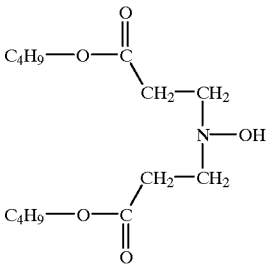

Then, silver halide photographic light-sensitive materials 102 to 117 (comparative example) and 118 to 125 (Example) were respectively made each having the same composition as that of the silver halide photographic light-sensitive material 101 (comparative example) except that the coupler and/or developing agent in each layer was substituted in equivalent mol as shown in Table 6.

D-1 and D-7 in the column of a developing agent in Table 6 each indicate the compound (developing agent) represented by the above-described general formula (1). C-6, C-22, C-45, C-48, C-85, C-96, C-117 and C-124 each indicate the above-described specific example of the coupler.

Thus obtained silver halide photographic light-sensitive materials 101 to 117 (comparative example) and 118 to 125 (Example) were exposed at 2500 lux for 0.01 second through a gray filter on which concentration varies continuously. Onto this exposed sensitive surface was poured 15 ml/m$^2$ of hot water of 40° C., and the light-sensitive material was laminated on a treating sheet in such a manner that each film surface faces to the other film surface, then heat developing was effected at 83° C. for 30 seconds using a heat drum.

After the treatment, the treating sheet was peeled, a clear image was obtained on the silver halide photographic light-sensitive material side corresponding to the exposed filter. Transmission concentrations of Dmax of an exposed portion and Dmin of white portion of this sample were measured directly after the above-described treatment using X-rite concentration measuring machine, and the results are shown in Table 7. In Table 7, a measuring filter is changed corresponding to a coupler. (B), (G) and (R) indicate measured concentrations at B filter, G filter and R filter, respectively.

TABLE 6

| Light-sensitive material No. | Coupler | Developing agent |
|---|---|---|
| 101 (Comparative Example) | (1) = C-22 | (2) |
| 102 (Comparative Example) | (1) = C-22 | A |
| 103 (Example) | (1) = C-22 | D-11 |
| 104 (Comparative Example) | C-6 | (2) |
| 105 (Comparative Example) | C-48 | B |
| 106 (Example) | C-45 | D-1 |
| 107 (Example) | C-6 | D-1 |
| 108 (Example) | C-48 | D-11 |
| 109 (Comparative Example) | C-96 | (2) |
| 110 (Comparative Example) | C-85 | (2) |
| 111 (Comparative Example) | C-124 | (2) |
| 112 (Comparative Example) | C-96 | A |
| 113 (Comparative Example) | C-85 | A |
| 114 (Comparative Example) | C-124 | A |
| 115 (Comparative Example) | C-96 | B |
| 116 (Comparative Example) | C-117 | B |
| 117 (Comparative Example) | C-117 | A |
| 118 (Example) | C-96 | D-1 |
| 119 (Example) | C-85 | D-1 |
| 120 (Example) | C-124 | D-1 |
| 121 (Example) | C-96 | D-11 |
| 122 (Example) | C-85 | D-11 |
| 123 (Example) | C-124 | D-11 |
| 124 (Example) | C-96 | D-18 |
| 125 (Example) | C-117 | D-18 |

TABLE 7

| Light-sensitive material No. | Color developing hue | Dmax | Dmin |
|---|---|---|---|
| 101 (Comparative Example) | G | 3.42 | 0.28 |
| 102 (Comparative Example) | G | 3.33 | 0.28 |
| 103 (Example) | G | 3.44 | 0.28 |
| 104 (Comparative Example) | B | 2.21 | 0.27 |
| 105 (Comparative Example) | R | 3.61 | 0.27 |
| 106 (Example) | R | 3.62 | 0.27 |
| 107 (Example) | B | 2.19 | 0.28 |
| 108 (Example) | R | 3.55 | 0.27 |
| 109 (Comparative Example) | G | 0.28 | 0.11 |
| 110 (Comparative Example) | B | 0.29 | 0.11 |
| 111 (Comparative Example) | R | 0.28 | 0.12 |
| 112 (Comparative Example) | G | 0.28 | 0.11 |
| 113 (Comparative Example) | B | 0.27 | 0.13 |
| 114 (Comparative Example) | R | 0.29 | 0.12 |
| 115 (Comparative Example) | G | 0.29 | 0.11 |
| 116 (Comparative Example) | R | 0.29 | 0.11 |
| 117 (Comparative Example) | R | 0.30 | 0.12 |
| 118 (Example) | G | 3.27 | 0.27 |
| 119 (Example) | B | 2.21 | 0.28 |

TABLE 7-continued

| Light-sensitive material No. | Color developing hue | Dmax | Dmin |
|---|---|---|---|
| 120 (Example) | R | 3.37 | 0.27 |
| 121 (Example) | G | 3.30 | 0.28 |
| 122 (Example) | B | 2.09 | 0.28 |
| 123 (Example) | R | 3.37 | 0.27 |
| 124 (Example) | G | 3.29 | 0.28 |
| 125 (Example) | R | 3.40 | 0.28 |

Developing agent A

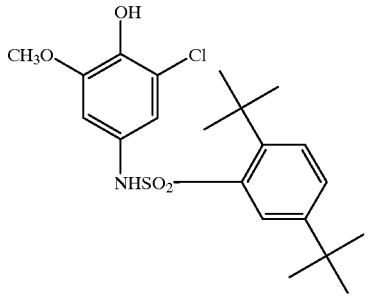

Developing agent B

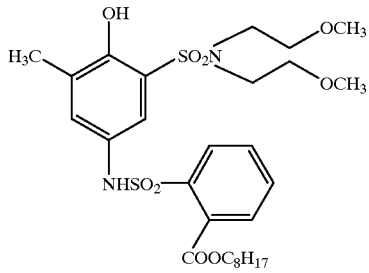

The results shown in Table 7 show that 4-equivalent couplers were used in the silver halide photographic light-sensitive materials 101 to 108, and in any case, a dye image was formed. Among the silver halide photographic light-sensitive materials 109 to 125 in which the coupler was changed, only the silver halide photographic light-sensitive materials 118 to 125 (Example) in which the compound (developing agent) represented by the general formula (1) of the present invention was used developed color. The effect of the present invention is apparent from the above-described results.

(Example 2)

<Preparation of light-sensitive silver halide emulsion-2>

To a well stirred aqueous solution having a composition shown in Table 8 was added a solution (I) and a solution (II) having compositions respectively shown in Table 9 simultaneously for 9 minutes at constant flow rate. After 5 minutes, a solution (III) andasolution (IV) having composition respectively shown in Table 9 were added simultaneously for 32 minutes at constant flow rate. After completion of the addition of the solutions (III) and (IV), 60 ml of a methanol solution of dyes (containing 360 mg of dye 1 and 73.4 mg of dye 2) was added in one lump. After washing with water and desalting (conducted at pH of 4.0 using flocculating agent a) in an usual manner, to this was added 22 g of lime-treated ossein gelatin, and pH was controlled to 6.0 and pAg was controlled to 7. 6. To this were added 1.8 mg of sodium thiosulfate and 180 mg of 4-hydroxy-6-methyl-1,3,3a, 7-tetrazaindene. Chemical sensitization was appropriately conducted at 60° C., then 90 mg of an anti-fogging agent 3 was added before cooling. In this way, 635 g of a monodispersed cubic silver chlorine bromide emulsion having an average particle size of 0.30 $\mu$m was obtained.

Further, a silver halide photographic light-sensitive material 201 having a composition shown in Table 10 (comparative example) was made.

TABLE 8

| Composition | |
|---|---|
| $H_2O$ | 620 cc |
| Lime-processed gelatin | 20 g |
| KBr | 0.3 g |
| NaCl | 2.0 g |
| Solvent for silver halide (4) | 0.03 g |
| 1N sulfuric acid | 16 cc |
| Temperature 45° C. | |

TABLE 9

| | Solution (I) | Solution (II) | Solution (III) | Solution (IV) |
|---|---|---|---|---|
| $AgNO_3$ | 30.0 g | — | 70.0 g | — |
| kBr | — | 13.7 g | — | 44.2 g |
| NaCl | — | 3.62 g | — | 2.4 g |
| Potassium ferrocyanide | — | — | — | 0.07 g |
| $K_2IrCl_5$ | — | — | — | 0.04 mg |
| Total amount | 188 ml (by addition of water) | 188 ml (by addition of water) | 250 ml (by addition of water) | 250 ml (by addition of water) |

Sensitizing dye (1)

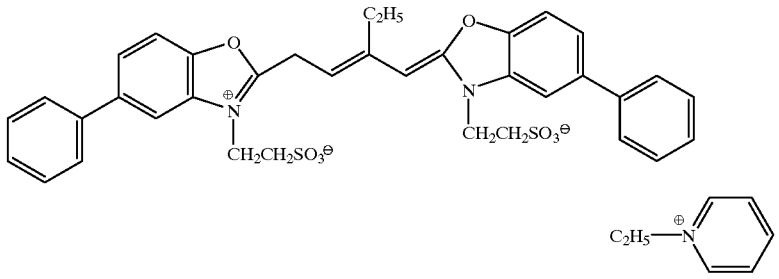

Sensitizing dye (2)

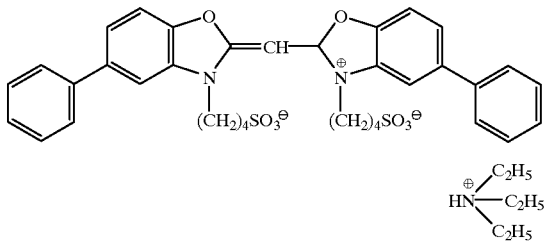

Flocculating agent a

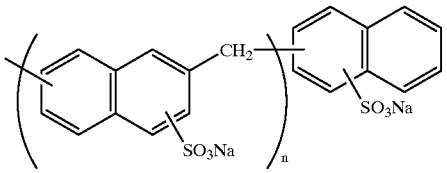

Anti-fogging agent (3)

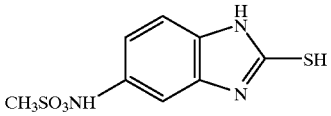

Solvent for silver halide (4)

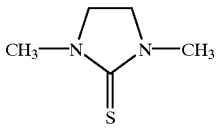

TABLE 10

Structure of light-sensitive material 201

| Constituent layer | Added substance | Amount added ($mg/m^2$) |
|---|---|---|
| 3rd layer | Lime-processed gelatin | 600 |
| Protective layer | Matting agent (silica) | 50 |
| | Surfactant (5) | 80 |
| | Surfactant (6) | 200 |
| | Water-soluble polymer (7) | 15 |
| | Hardener (8) | 18 |
| 2nd layer | Lime-processed gelatin | 400 |
| Intermediate layer | Surfactant (6) | 15 |
| | Zinc hydroxide | 700 |
| | Water-soluble polymer (7) | 15 |
| lst layer | Light-sensitive silver | based on silver 540 |
| Color developing | halide emulsion-2 | |
| layer | Lime-processed gelatin | 600 |
| | Anti-fogging agent (11) | 2 |
| | Coupler (24) | 195 |
| | Developing agent (2) | 164 |
| | Organic Solvent having a high boiling point (3) | 180 |
| | Surfactant (4) | 20 |
| | Water-soluble polymer (7) | 10 |
| | Transparent PET base (102 $\mu$m) | |

Coupler (24)

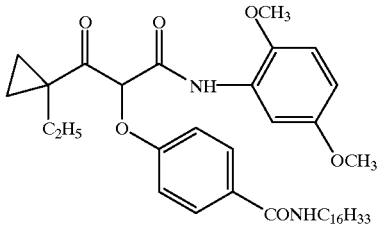

Further, an image receiving sheet R-2 was made having the same composition as that of the treating sheet R-1 except that palladium sulfide and hydantoin potassium were removed from the treating sheet R-1 in Example 1.

Then, silver halide photographic light-sensitive materials 202 to 210 (comparative example) and 211 to 220 (Example) were respectively made each having the same composition as that of the silver halide photographic light-sensitive material 201 (comparative example) except that the coupler and developing agent in each layer were substituted in equivalent mols as shown in Table 11.

D-1, D-3, D-7 and D-18 in the column of a developing agent in Table 11 each indicate the compound (developing agent) represented by the above-described general formula (1). C-173, C-177, C-182 and C-188 in the column of a coupler each indicate the above-described specific example of the coupler.

TABLE 11

| Light-sensitive material No. | Coupler | Developing agent |
|---|---|---|
| 201 (Comparative example) | (29) = C-173 | (2) |
| 202 (Comparative example) | C-177 | (2) |
| 203 (Comparative example) | C-188 | (2) |
| 204 (Comparative example) | C-182 | (2) |
| 205 (Comparative example) | C-173 | A |
| 206 (Comparative example) | C-177 | A |
| 207 (Comparative example) | C-188 | A |
| 208 (Comparative example) | C-173 | B |
| 209 (Comparative example) | C-177 | B |
| 210 (Comparative example) | C-188 | B |
| 211 (Example) | C-173 | D-1 |
| 212 (Example) | C-177 | D-1 |
| 213 (Example) | C-188 | D-1 |
| 214 (Example) | C-173 | D-18 |
| 215 (Example) | C-177 | D-18 |
| 216 (Example) | C-188 | D-18 |
| 217 (Example) | C-173 | D-11 |
| 218 (Example) | C-177 | D-11 |
| 219 (Example) | C-188 | D-11 |
| 220 (Example) | C-188 | D-10 |

Thus obtained silver halide photographic light-sensitive materials 201 to 210 (comparative example) and 211 to 220 (Example) were exposed at 2500 lux for 0.01 second through a gray filter on which concentration varies continuously. Onto this exposed sensitive surface was poured 15 $ml/m^2$ of hot water of 40° C., and the light-sensitive material was laminated on an image receiving sheet in such a manner that each film surface faces to the other film surface, then heat developing was effected at 83° C. for 17 seconds using a heat drum. After the treatment, the image receiving sheet was peeled, a clear transfer dye image was obtained on the image receiving sheet corresponding to the exposed filter on the silver halide photographic light-sensitive material side.

Reflection concentrations of Dmax of an exposed portion and Dmin of white portion of this sample were measured directly after the above-described treatment using X-rite concentration measuring machine, and the results are shown in Table 12. In Table 12, a measuring filter is changed corresponding to a coupler like Example 1. (B), (G) and (R) indicate measured concentrations at B filter, G filter and R filter, respectively.

The results shown in Table 12 show the following facts: In the silver halide photographic light- sensitive materials 201 to 210 (comparative example), no dye image was formed on the image receiving sheet when any developing agent was used, since a coupler in which a releasing group was substituted by a was used. On the other hand, in the silver halide photographic light-sensitive materials 210 to 220 (Example) in which the compound represented by the general formula (1) was used, a dye image was formed. The effect of the present invention is apparent from the above-described results.

TABLE 12

| Light-sensitive material No. | Color developing hue | Dmax | Dmin |
|---|---|---|---|
| 201 (Comparative example) | B | 0.24 | 1.12 |
| 202 (Comparative example) | G | 0.24 | 0.16 |
| 203 (Comparative example) | R | 0.26 | 0.12 |
| 204 (Comparative example) | R | 0.25 | 0.12 |
| 205 (Comparative example) | B | 0.25 | 0.14 |
| 206 (Comparative example) | G | 0.24 | 0.16 |
| 207 (Comparative example) | R | 0.25 | 0.11 |
| 208 (Comparative example) | B | 0.24 | 0.11 |
| 209 (Comparative example) | G | 0.22 | 0.17 |
| 210 (Comparative example) | R | 0.23 | 0.12 |
| 211 (Example) | B | 1.57 | 0.12 |
| 212 (Example) | G | 2.03 | 0.18 |
| 213 (Example) | R | 2.10 | 0.15 |
| 214 (Example) | B | 1.53 | 0.13 |
| 215 (Example) | G | 2.02 | 0.18 |
| 216 (Example) | R | 2.14 | 0.14 |
| 217 (Example) | B | 1.59 | 0.13 |
| 218 (Example) | G | 2.04 | 0.19 |
| 219 (Example) | R | 2.20 | 0.13 |
| 220 (Example) | R | 2.18 | 0.13 |

What is claimed is that:

1. A silver halide photographic light-sensitive material comprising a support having thereon at least one layer comprising at least one compound represented by the following general formula (1):

(1)

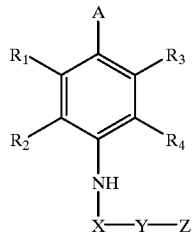

wherein $R_1$ to $R_4$ represent a hydrogen atom or substituent, A represents a hydroxyl group or a substituted amino group, X represents a first connecting group selected from —CO—, —SO—, —$SO_2$— and —PO<, Y represents a second, bivalent connecting group selected from the group consisting of a 1,2-cycloalkylene group, a 1,2-arylene group and a 1,8-naphthylene group, Z represents a group which is nucleophilic and can attack X when the present compound is oxidized, Y and Z are connected so that a 5- to 6-membered ring can be formed containing 5 to 6 atoms in a transition condition when the nucleophilic group effects nucleophilic attack to X, and $R_1$ and $R_2$ may be linked with each other to form a ring and $R_3$ and $R_4$ may be linked with each other to form a ring.

2. The silver halide photographic light-sensitive material according to claim 1, wherein A in the general formula (1) represents a hydroxyl group.

3. The silver halide photographic light-sensitive material according to claim 1, wherein further the material contains a 2-equivalent coupler.

4. The silver halide photographic light-sensitive material according to claim 1, wherein the substituent of $R_1$ to $R_4$ is independently selected from the group consisting of a halogen atom, an alkyl group, an aryl group, a carbonamide group, a sulfonamide group, an alkoxy group, an aryloxy group, an alkylthio group, an arylthio group, a carbamoyl group, a sulfamoyl group, a cyano group, a sulfonyl group, an alkoxycarbonyl group, an aryloxycarbonyl group, an acyl group, a ureido group, a urethane group, and an acyloxy group.

5. The silver halide photographic light-sensitive material according to claim 1, wherein if A represents a hydroxy group, the total of Hammett's constants $\sigma_p$ of $R_1$ to $R_4$ is 0 or more.

6. The silver halide photographic light-sensitive material according to claim 1, wherein if A represents a substituted amino group, the total of Hammett's constants $\sigma_p$ of $R_1$ to $R_4$ is 0 or less.

7. The silver halide photographic light-sensitive material according to claim 1, wherein Z contains a moeity selected from the group consisting of —NH—, —CONH—, and >N—O—.

* * * * *